US006276327B1

(12) United States Patent
Fukuoka et al.

(10) Patent No.: US 6,276,327 B1
(45) Date of Patent: Aug. 21, 2001

(54) ENGINE LAYOUT FOR OUTBOARD MOTOR

(75) Inventors: Yoshihito Fukuoka; Hiroshi Oishi; Atsushi Kumita, all of Hamamatsu (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/496,000

(22) Filed: Feb. 1, 2000

(30) Foreign Application Priority Data

Feb. 1, 1999 (JP) ..... 11-024454
Feb. 1, 1999 (JP) ..... 11-024455
Feb. 1, 1999 (JP) ..... 11-024456

(51) Int. Cl.[7] ..... F02F 7/00; F01M 11/00
(52) U.S. Cl. ..... 123/196 W; 123/195 P
(58) Field of Search ..... 123/196 R, 196 AB, 123/196 W, 196 CP, 195 C, 195 P, 195 CH; 446/89, 88, 900

(56) References Cited

U.S. PATENT DOCUMENTS 4,541,368 * 9/1985 Castarede ..... 123/41.33
5,513,608 * 5/1996 Takashima et al. ..... 123/196 W
5,555,855 * 9/1996 Takahashi ..... 123/41.08
5,775,285 * 7/1998 Takahashi ..... 123/196 A
5,778,847 * 7/1998 TAkahashi et al. ..... 123/195 P
5,899,778 * 5/1999 Hiraoka et al. ..... 440/88
5,904,604 * 5/1999 Suzuki et al. ..... 440/84
5,924,901 * 7/1999 Takahashi et al. ..... 440/88
5,954,022 * 9/1999 Katayama et al. ..... 123/195 P
5,984,742 * 11/1999 Kimura et al. ..... 440/77

* cited by examiner

*Primary Examiner*—Noah P. Kamen
*Assistant Examiner*—Hai Huynh
(74) *Attorney, Agent, or Firm*—Knobbe, Martens, Olson & Bear, LLP

(57) ABSTRACT

An improved arrangement of an outboard motor reduces the size of the outboard motor and improves a lubrication system of the outboard motor. Intake and exhaust passages are located along a side of a cylinder body. A crank case lubricant return passage is located on the same side of the cylinder body as the intake and exhaust passages. The return passages have openings located on an inner surface of the crank case. A breather passage connecting a cam chamber and an lubricant reservoir are located on a side of the cylinder body opposite the intake and exhaust passage. The lubricant reservoir including a drain and an insertion port. The insertion port being pointed towards the drain.

28 Claims, 22 Drawing Sheets

ENGINE LAYOUT FOR OUTBOARD MOTOR

BACKGROUND OF THE INVENTION

1. Field of the Invention

This invention relates to an arrangement of components for an engine, and particularly to an arrangement of a lubrication system, an intake system, an exhaust system and a cooling system for an outboard motor.

2. Description of Related Art

The air intake and exhaust systems of an engine can be arranged in a variety of ways. One of the most common arrangements is a cross-flow type in which the air intake system and the exhaust system are disposed on opposite sides of the engine. Another arrangement, which is not so common, is a counter-flow type in which, unlike the cross-flow type, the air intake system and the exhaust system are disposed on the same side of the engine.

There are several advantages to the counter-flow type engine. For example, because the air intake passage is positioned close to the exhaust passage, the intake air charge is warmed by the heat of the exhaust gasses. This expedites engine warm up, particularly during a cold conditions.

Another advantage of the counter-flow type of engine is that there is room on the side opposite the intake and exhaust systems for other engine components. Alternatively, this side of the engine can be placed closer to an inner wall of an engine compartment or a protective cowling.

A counter-flow type of engine includes a cylinder body that defines a cylinder bore or cylinder bores in which a piston or pistons reciprocate and a cylinder head affixed on an end of the cylinder body. The cylinder head, the pistons (s), and the cylinder bore(s) define a combustion chamber or combustion chambers. In general, part of the air intake system and the exhaust system are formed in the cylinder head. Because both of these systems are positioned on the same side of the engine, they occupy a relatively large space. This increases the size of the engine. A need therefor exists for an improved arrangement of the other engine components, and in particular, the lubrication system to make the counter-flow engine as compact as possible.

Outboard motors (counter or cross-flow types) typically include a vertically disposed crank chamber, which houses a vertically disposed crankshaft. Lubricant is supplied to the crank chamber by the lubrication system. Typically, lubricant is sprayed into the crank chamber and is deposited on the inner wall of the crank chamber because of the airflow generated by the circular motion of the crankshaft. The lubricant then flows down the sides of the crank chamber and collects at the bottom of the crank chamber. A return passage is usually provided at the bottom of the crank chamber. Lubricant flows through the return passage and is returned to an lubricant reservoir, which is usually located beneath the engine. A problem with this arrangement is that it typically takes a long time for the lubricant to travel down the sides of the crank chamber. Accordingly, a larger amount of lubricant is required in the lubrication system. A need therefore exists for a lubrication system that reduces the amount of time it takes for the lubricant to travel through the crank chamber.

Most outboard motors (counter or cross-flow types) are stored on their side with one side of the engine facing upward. While in this position, lubricant can accumulate in the crank chamber of the engine. The lubricant may then leak into the combustion chamber through the space between the cylinders and the piston. When the engine is started, this lubricant may cause poor emissions and retard ignition. It is, therefore, another object of the present invention to provide an improved lubrication system that prevents lubricant from accumulating in the crank chamber during storage.

It is well known that the lubricant in the lubricant reservoir must be periodically removed and changed. Accordingly, an lubricant drain for the lubricant reservoir is provided and is typically located near the center or rear side of the bottom surface of the lubricant reservoir. To add lubricant, an insertion port is also provided. Usually, the lubricant is drained from the reservoir by removing a plug of the lubricant drain. Alternatively, lubricant can be sucked out of the lubricant reservoir through a suction pipe that has been inserted into the insertion port. Typically, a problem with both of these methods is that old lubricant still remains in the bottom of the lubricant reservoir. A need therefore exists for an improved means for removing most or all of the lubricant from the lubricant reservoir.

SUMMARY OF THE INVENTION

In accordance with one aspect of the present invention includes an outboard motor that comprises an internal combustion engine, an exhaust guide, and a lubrication system. The lubrication system includes a lubricant reservoir that is located below the exhaust guide. The engine comprises a cylinder body, which defines a plurality of cylinder bores in which pistons reciprocate. The pistons are coupled to a crankshaft, which is covered by a crank case forming a crank chamber. A cylinder head is affixed to an end of said cylinder body. A combustion chamber is defined between the pistons and the cylinder bores. A plurality of air intake passages supply air charges to the combustion chambers. A plurality of exhaust passages discharge burnt charges from the combustion chambers. The intake and exhaust passages are located on the same side of the cylinder body. At least one crank chamber lubricant return passage communicates with the crank chamber and the lubricant reservoir. The return passage is located on the same side of the cylinder body as the intake and exhaust passages. An opening of the crank case return passage is located at least in part on a substantially vertical side wall of the crank case.

Another aspect of the present invention involves an outboard motor comprising an internal combustion engine, an exhaust guide, and a lubrication system including. The lubrication system includes a lubricant reservoir that is located below the exhaust guide. The engine comprises a cylinder body that defines a plurality of cylinder bores in which pistons reciprocate. The pistons are coupled to a crankshaft that is covered by a crank case that forms a crank chamber. A cylinder head is affixed to an end of said cylinder body and defines a combustion chamber along with the pistons and the cylinder bores. A plurality of air intake passages supply air charges to the combustion chambers. A plurality of exhaust passages discharge burnt charges from the combustion chambers. The intake and exhaust passages are located on the same side of the cylinder body. At least one crank chamber lubricant return passage communicates with the crank chamber and the lubricant reservoir. The return passage is located on the same side of the cylinder body as the intake and exhaust passages.

Yet another aspect of the present invention involves an outboard motor comprises an internal combustion engine and a lubrication system for lubricating the engine. The lubrication system includes a lubricant reservoir that is located below the engine. The engine includes a cylinder body that defines a plurality of cylinder bores in which pistons reciprocate. The pistons are coupled to a crank shaft. A crank case covers the crank shaft. The reservoir includes an insertion port located on an upper side of the reservoir and a drain located under the insertion port. The insertion port is pointed towards the drain.

Another aspect of the present invention involves an outboard motor comprises an internal combustion engine and a lubrication system for lubricating the engine. The lubrication system includes a lubricant reservoir that is located below the engine. The engine includes a cylinder body that defines a plurality of cylinder bores in which pistons reciprocate. The pistons are coupled to a crank shaft. A crank case covers the crank shaft. The insertion port and said drain being located in a same vertical plane.

Another aspect of the invention involving an outboard motor that includes an internal combustion engine and a lubrication system for lubricating the engine. The lubrication system includes a lubricant reservoir that is located below the engine. The engine includes a cylinder body that defines a plurality of cylinder bores in which pistons reciprocate. The pistons are coupled to a vertically extending crankshaft. A crank case covers the crank shaft. The lubrication system including a crank case return passage that communicates with the reservoir and the crank case. An opening of said crank case return passage is located at least in part on a substantially vertical side wall of the crank case.

Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention. The drawings contain the following figures.

DETAILED DESCRIPTION OF THE PREFERRED EMBODIMENTS OF THE INVENTION

The present invention generally relates to an improved arrangement for components of an engine. The arrangement is described in conjunction with an outboard motor and in particular a counter-flow type outboard motor because this an environment in which the present invention has particular utility. Those of ordinary skill in the relevant arts will readily appreciate that various aspects and features of the present invention also can be employed with other engines such as, for example, watercraft, all terrain vehicles, automobile and motorcycle engines.

Figure 1:
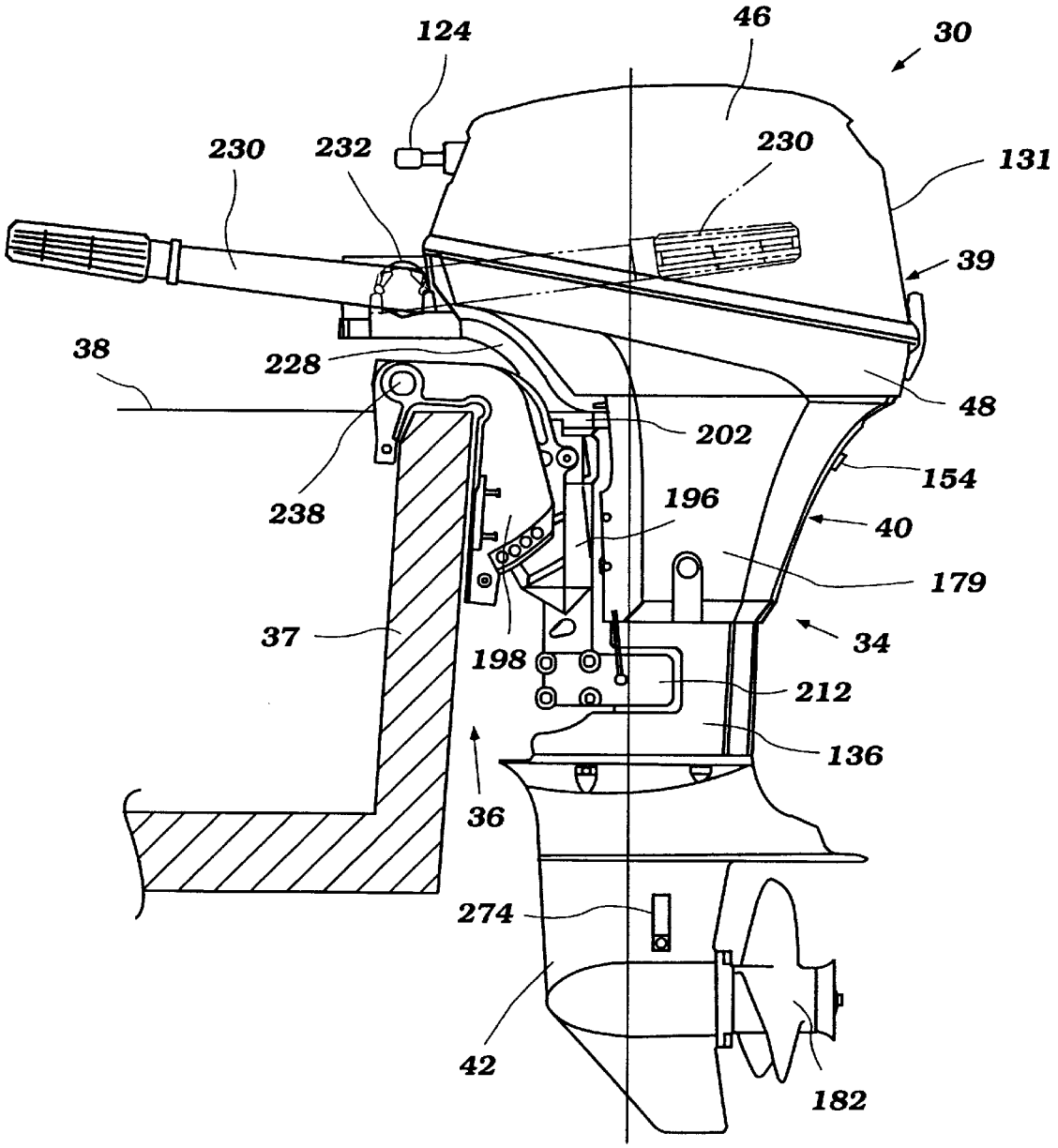
FIG. 1 is a side elevational view showing an outboard motor configured in accordance with a preferred embodiment of the present invention. The figure displays the portside structure of the outboard motor. An associated watercraft is partially shown in section.
Figure 2:
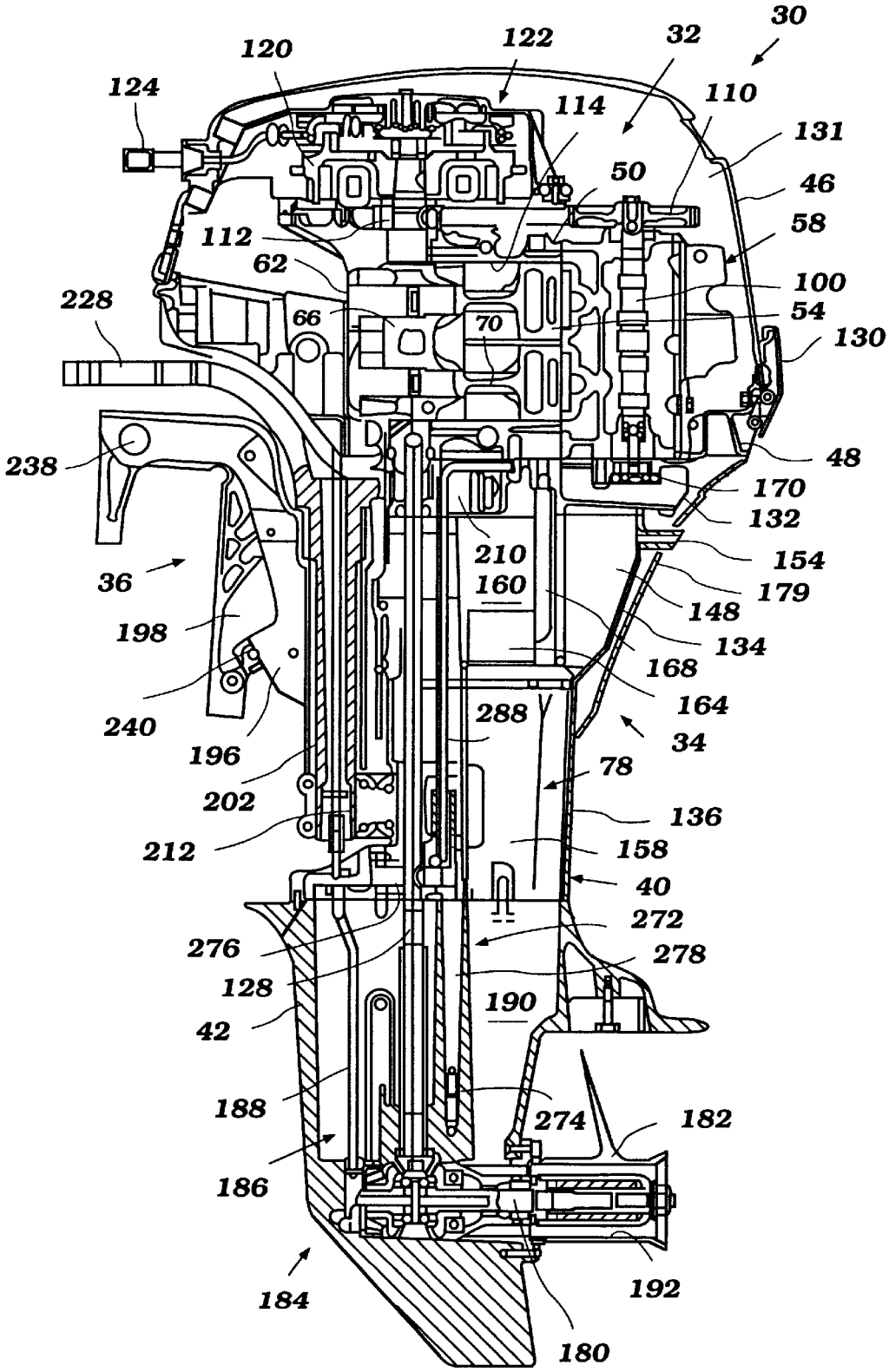
FIG. 2 is a cross-sectional, side elevational view showing the portside structure of the outboard motor of FIG. 1.

With reference now to FIGS. 1 and 2, an outboard motor, designated generally by reference numeral 30, is illustrated. The outboard motor 30 includes an internal combustion engine 32 arranged in accordance with a preferred embodiment of this invention. In the illustrated embodiment, the outboard motor comprises a drive unit 34 and a bracket assembly 36. The drive unit 34 is affixed to a transom 37 of an associated watercraft 38 by the bracket assembly 36. The drive unit 34 includes a power head 39, a driveshaft housing 40 and a lower unit 42. The power head 39 is disposed atop of the drive unit 34 and includes the engine 32, a top protective cowling 46 and a bottom protective cowling 48.

Throughout this description, the terms "fore," "forward," "front," and "forwardly" mean at or to the side where the bracket assembly 36 is located. The terms "rear," "reverse," "back," and "forwardly" mean at or to the opposite side of the front side, unless indicated otherwise. The terms "port-side" and "starboard side" mean the left-hand side and the right-hand side, respectively, when looking forwardly.

The engine 32 operates on a four stroke combustion principle and powers a propulsion device. The engine 32 has a cylinder body or block 50. In the illustrated embodiment, the cylinder body 50 defines two cylinder bores 52 generally horizontally extending and spaced generally vertically with each other. That is, the engine 32 is a L2 (in-line 2 cylinder) type. This type of engine, however, is merely exemplary of a type in which various aspect and features of the present invention can be used. The engine, of course, can have other number of cylinders and certain aspects of the present invention can be used with engines having other configurations of cylinders.

Figure 8:
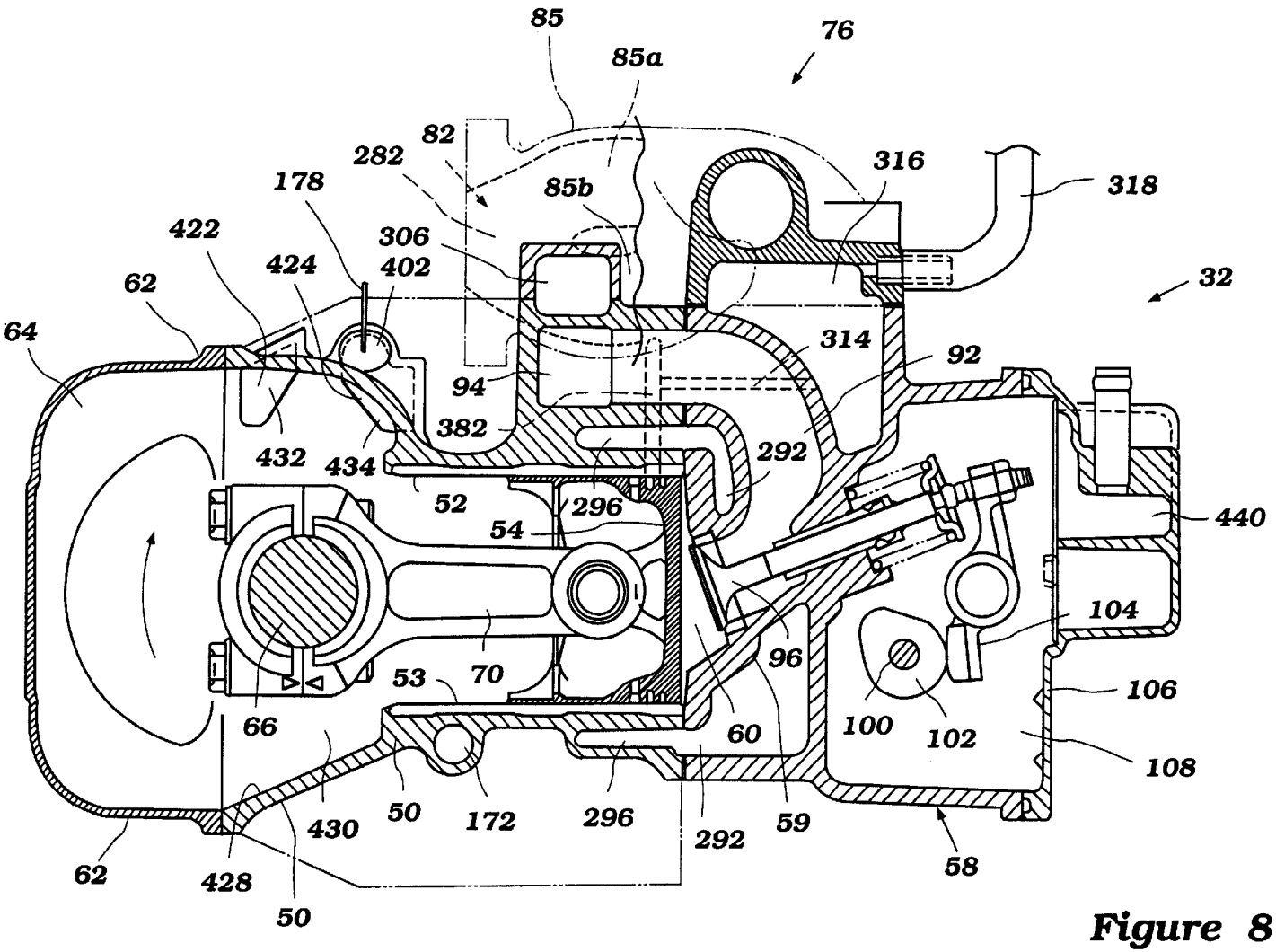
FIG. 8 is a cross-sectional top plan view showing the engine. An air intake system is illustrated in phantom.

As best seen in FIG. 8, a cylinder liner 53 is inserted within each cylinder of the cylinder body 50 and defines a cylinder bore 52. The term "cylinder bore" means a surface of this cylinder liner 53 in this description. A piston 54 can reciprocate in each cylinder bore 52. A cylinder head assembly 58, more specifically a cylinder head member 59, is affixed to one end of the cylinder body 50 and defines two combustion chambers 60 with the pistons 54 and the cylinder bores 52. The other end of the cylinder body 50 is closed with a crankcase member 62 defining a crankcase chamber 64 with the cylinder bores 52. A crankshaft or output shaft 66 extends generally vertically through the crankcase chamber 64. The crankshaft 66 is pivotally connected with the pistons 54 by connecting rods 70 and rotates with the reciprocal movement of the pistons 54. The crankcase member 64 is located at the most forward position of the powerhead 39, and the cylinder body 50 and the cylinder head assembly 58 extends rearwardly from the crankcase member 62 one after the other.

Figure 4:
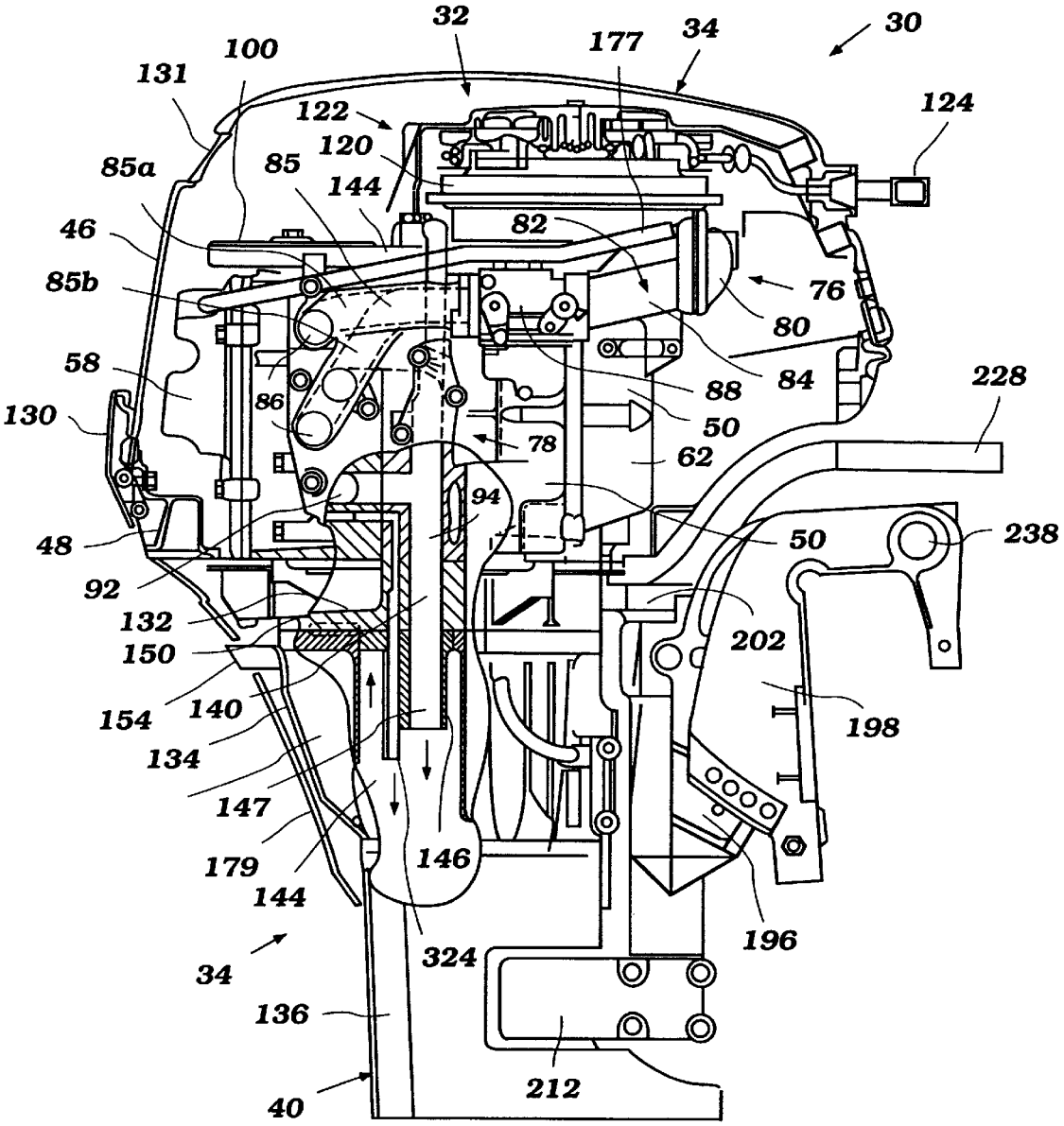
FIG. 4 is a cross-sectional, side elevational view showing a power head and the driveshaft housing of the starboard side of the outboard motor of FIG. 1. An engine of the power head and an exhaust guide member and an upper part of the driveshaft housing are partially sectioned but the lower part of the driveshaft housing is not sectioned.

As best seen in FIGS. 4 and 5, the engine 32 includes an air induction system 76 and an exhaust system 78. The air induction system 76 is arranged to supply air charges to the combustion chambers 60 and comprises an air intake section 80 and two air intake passages 82, which are unified and define a single intake manifold 84. Downstream portions of the intake passages 82 define an upper and lower intake runners 85*a,* 85*b,* which are formed by a single runner member 85. Air inner portions 86, specifically upper and lower inner portions 86*a,* 86*b,* complete the air intake passages 82. Because the inner portions 86 are formed within the cylinder head member 59, they define inner sections of the air intake passages 82. Meanwhile, the intake manifold 84 and the intake runner member 85 are placed outside of the cylinder head member 59 and hence they define outside sections thereof. The inner portions 86 are opened or closed by intake valves (not shown). When the inner portions 86 are opened, the air intake passages 82 communicate with the combustion chambers 60.

Carburetors 88 (FIG. 4) are interposed between the intake manifold 84 and the intake runner member 85 to supply fuel into the air intake passages 82. The carburetors 88 have throttle valves (not shown) therein. A fuel supply tank (not shown) is located on the associated watercraft 38 and the carburetors 88 are connected to the fuel supply tank. The air induction system 76 will be described in more detail below.

The engine of course can include a fuel injection system (either direct or indirect) in the place of the carburetors, which are shown merely as one type of charge formers that can be employed.

With continued reference to FIGS. 4 and 5, the exhaust system 78 is arranged to discharge burnt charges or exhaust gasses from the combustion chambers 60 outside of the outboard motor 30. Exhaust ports 92 are formed in the cylinder head member 59 and define exhaust passages. The exhaust ports 92 are connected to an exhaust manifold 94 disposed within the cylinder body 50. The exhaust manifold 94 leads the exhaust gasses downstream of the exhaust system 78. The exhaust ports 92 are opened or closed by exhaust valves 96 (FIG. 8). When the exhaust ports 92 are opened, the combustion chambers 60 communicate with the exhaust manifold 94 that leads the exhaust gasses downstream in the exhaust system 78. The exhaust system 78 also will be described in more detail below.

As best seen in FIG. 8, a camshaft 100 extends generally vertically and is journaled on the cylinder head member 59 to activate the intake valves and the exhaust valves 96. The camshaft 100 includes cam lobes 102. Rocker arms 104 are interposed between the cam lobes 102 and the respective valves 96 to push the valves 96 open at a certain timing with the rotation of the camshaft 100 as is well known in the art. A return mechanism (e.g., a spring or a pneumatic or hydraulic lifter) bias the valves 96 closed. It is to be understood that the intake valves, which are not illustrated, are actuated in a similar manner.

With continued reference to FIG. 8, a cylinder head cover member 106 completes the cylinder head assembly 58. The cylinder head cover member 106 is affixed to the cylinder head member 60 to define a camshaft chamber 108.

Figure 7:
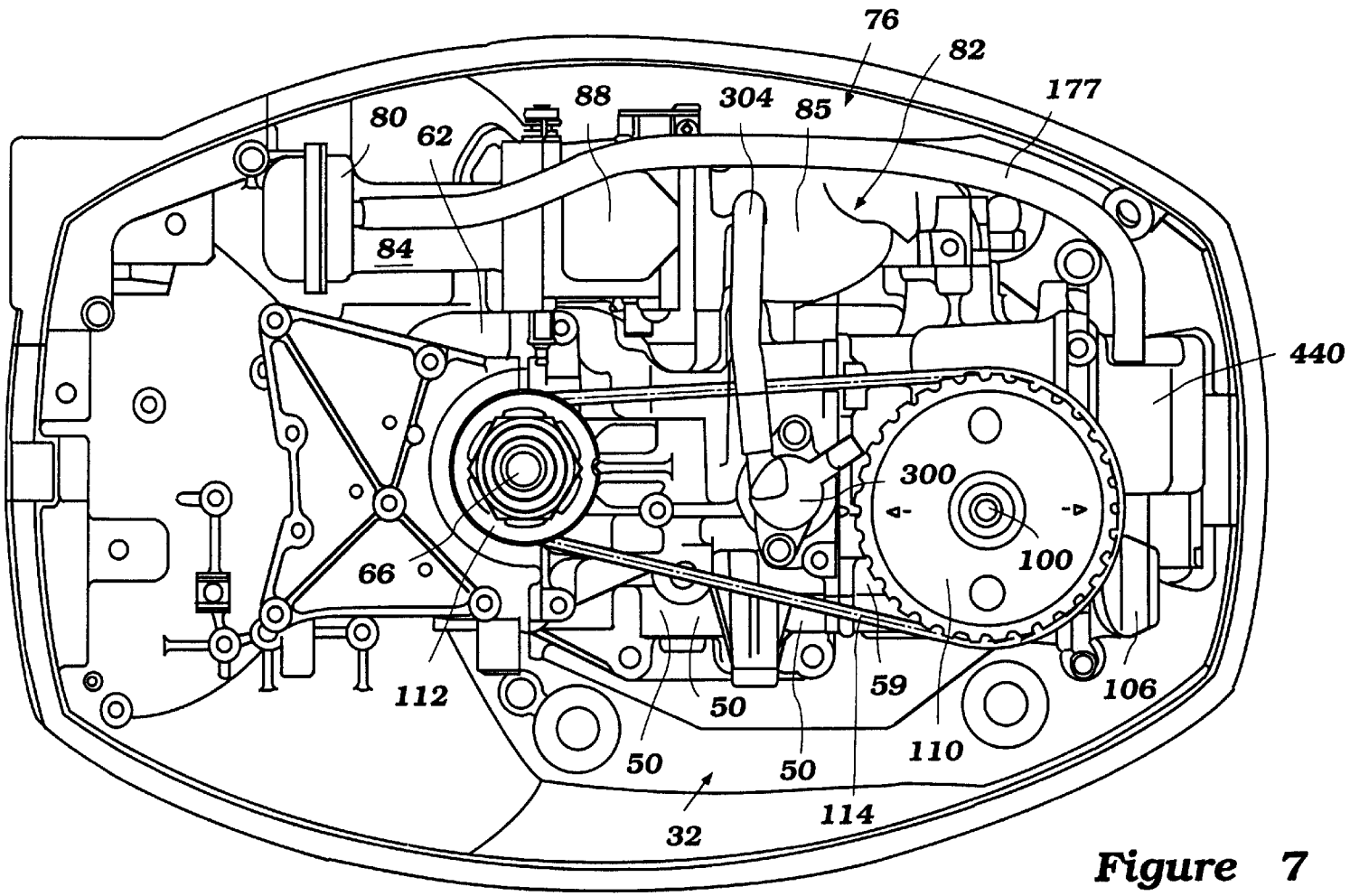
FIG. 7 is an enlarged top plan view showing the power head. A top cowling is removed in this figure.

As best seen in FIG. 7, the camshaft 100 is driven by the crankshaft 66. The camshaft 100 has a cogged pulley 110 thereon, while the crankshaft 66 also has a cogged pulley 112 thereon. The both pulleys 110, 112 are affixed to the respective shafts 100, 66 with nuts. A cogged or timing belt 114 is wound around the cogged pulleys 110, 112. Accordingly, rotation of the crankshaft 66 causes the camshaft 100 to rotate.

The engine 32 further includes a firing system, which is not shown. Two spark plugs are affixed on the cylinder head member 59 and exposed into the respective combustion chambers 60. The spark plugs fire an air/fuel charge at a certain firing timing to burn the air fuel charge.

With reference back to FIG. 4, a flywheel assembly 120 is affixed atop of the crankshaft 56. The flywheel assembly 120 includes a generator to supply electric power to the firing system and other electrical equipment. Additionally, the engine 32 includes a recoil starter 122. A starter lever 124 is provided outside of the top cowling 46. When the operator pulls the starter lever 124, the recoil starter 122 is actuated and starts the engine 32. While not illustrated, the engine also can include a starter motor in addition or in the alternative to the recoil starter. The use of a starter motor to drive the flywheel when starting the engine is preferred when the present invention is employed with larger size engines.

The top cowling 46 and the bottom cowling 48 generally completely enclose the engine 32 to protect it. The top cowling 46 is detachably affixed to the bottom cowling 48 with an affixing mechanism 130 so as to ensure access to the engine 32 for maintenance. The top cowling 46 has air intake openings 131 at its rear upper portion. Air can enter the interior of the cowlings 46, 48 and then it is introduced into the air induction system 76 through the air intake section 80.

Figure 3:
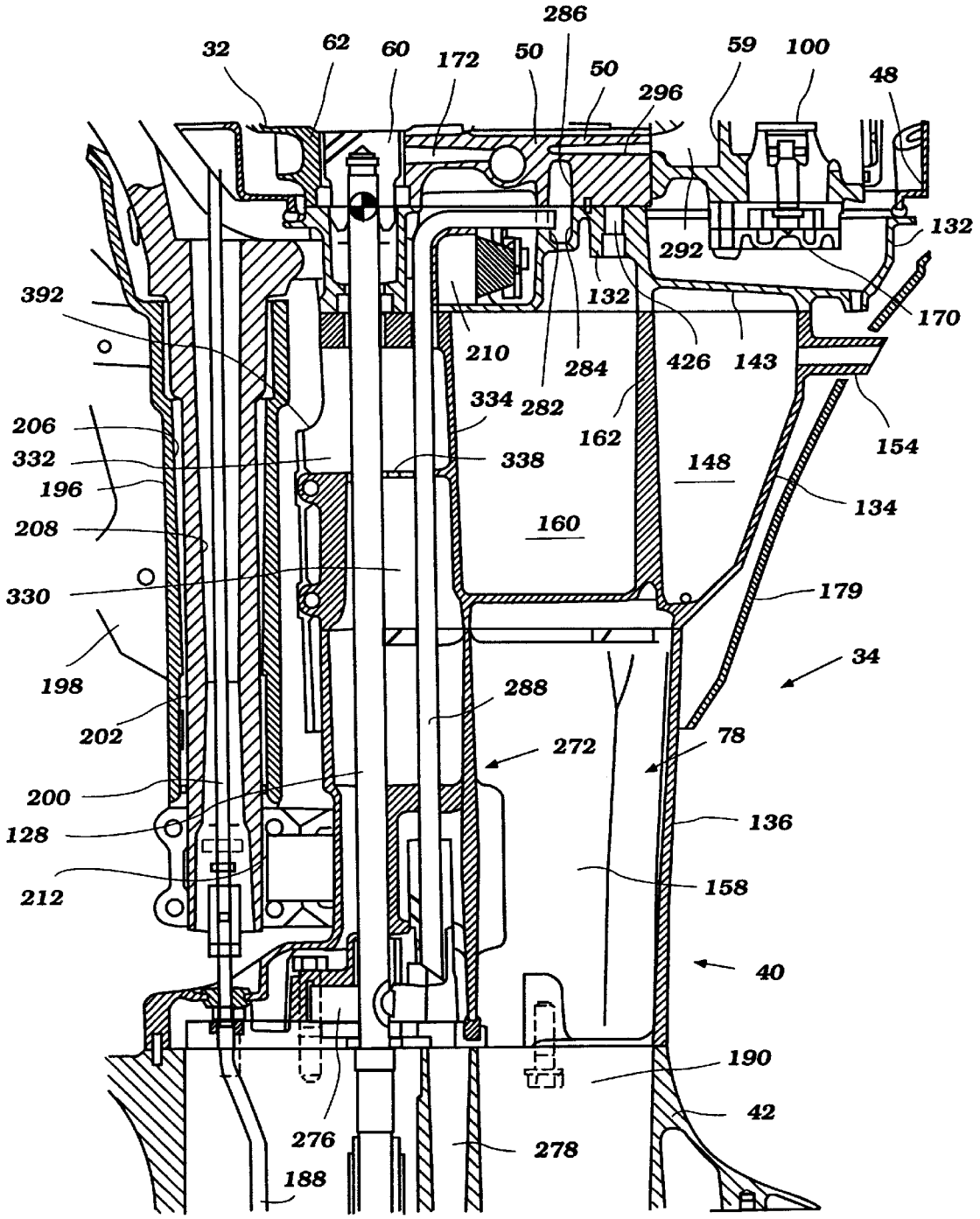
FIG. 3 is an enlarged cross-sectional, part side elevational view showing primarily a driveshaft housing of the outboard motor of FIG. 1.
Figure 10:
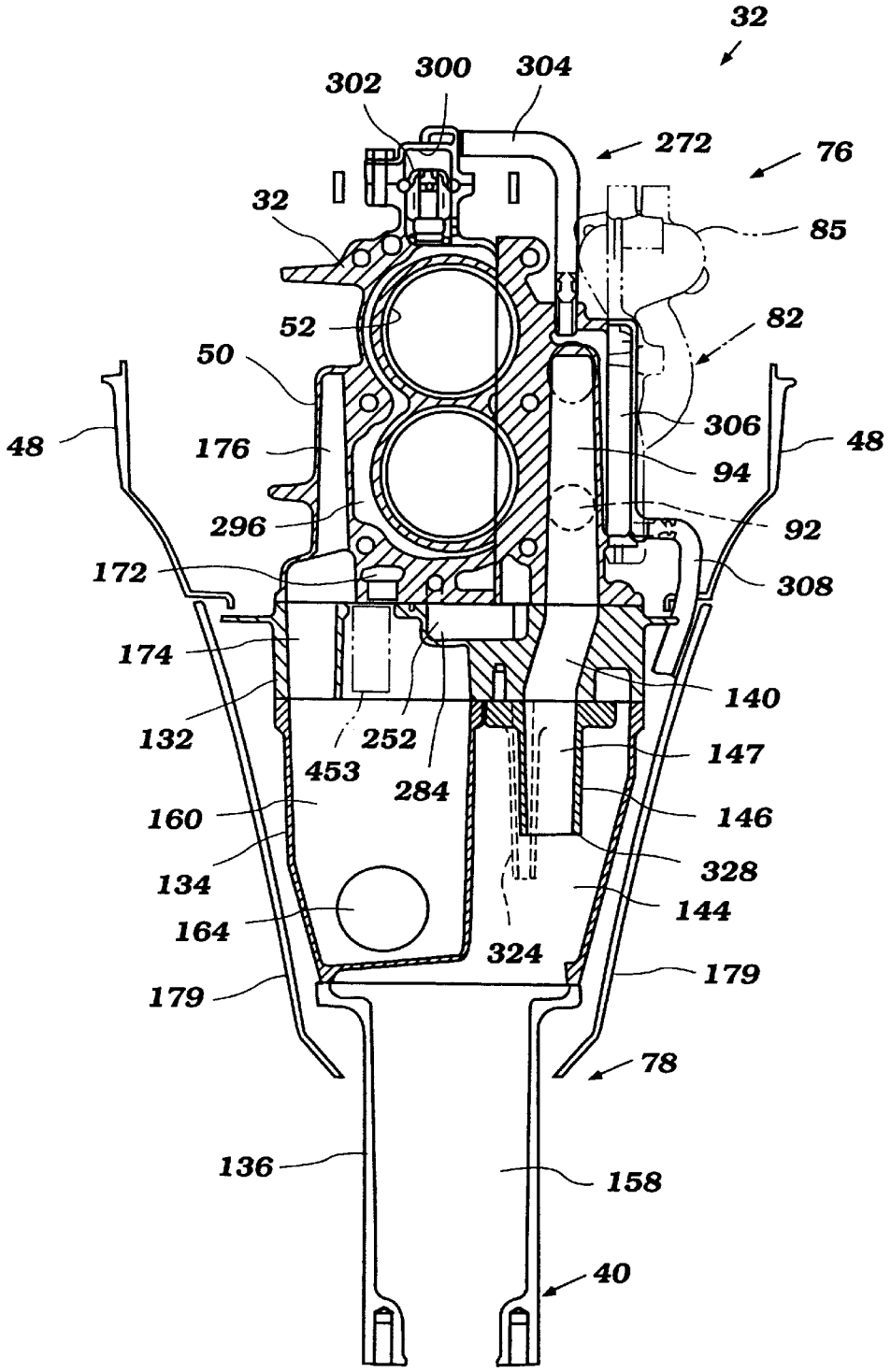
FIG. 10 is another cross-sectional rear view of the power head, the exhaust guide member and the driveshaft housing. The exhaust guide member and the driveshaft housing are sectioned along the line 10—10 in FIGS. 17 and 19. The air intake system, exhaust ports and an exhaust pipe cooling conduit are illustrated in phantom.

As shown in FIGS. 2 and 3, the driveshaft housing 40 depends from the power head 39 and supports the engine 32 and a driveshaft 128 which is driven by the crankshaft 66. The driveshaft housing 40 comprises an exhaust guide member 132, an upper housing member 134 and a lower housing member 136. The exhaust guide member 132 is placed atop of these three members. The engine 32 is mounted on this exhaust guide member 132 at a relatively forward portion thereof and fixed to it with bolts. In other words, a rear portion 143 of the exhaust guide member 132 is not affixed to the engine 32, specifically the cylinder head assembly 58, and hence projects rearwardly as a cantilever. The bottom cowling 48 also is affixed the exhaust guide member 132. As best shown in FIG. 10, the exhaust guide member 132 includes an exhaust guide section 140 that communicates with the exhaust manifold 94.

If the rear portion 143 and the cylinder head assembly 58 were to be joined together, the cylinder head assembly 58 would be connected to both the cylinder body 50 and the exhaust guide member 132. This construction would make it quite difficult to position these components accurately due to respective tolerances. However, as described above, the exhaust guide member 132 is not connected to the cylinder head assembly 58, but is connected only to the cylinder body 50 in this embodiment. The cylinder head assembly 58, therefore, is required to have accuracy only at its front face that is connected to the cylinder body 50. This reduces the cost of the engine 32 in machining and assembling of its components.

With continued reference to FIGS. 2 and 3, the upper housing member 134 is placed between the exhaust guide member 132 and the lower housing member 136. The driveshaft 128 extends generally vertically through the exhaust guide member 132, upper housing member 134 and lower housing member 136 and down to the lower unit 42.

As best seen in FIG. 10, an upper exhaust section 144 of the exhaust system 78 is defined between the exhaust guide member 132 and the upper housing member 134. In communication with the upper exhaust section 144, a lower exhaust section 158 is defined in the lower housing member 136. An exhaust pipe assembly 146 depends from the exhaust guide member 132 into the upper exhaust section 144. The exhaust pipe assembly 146 includes an exhaust pathway 147 therein which communicates with the exhaust guide section 140.

Figure 17:
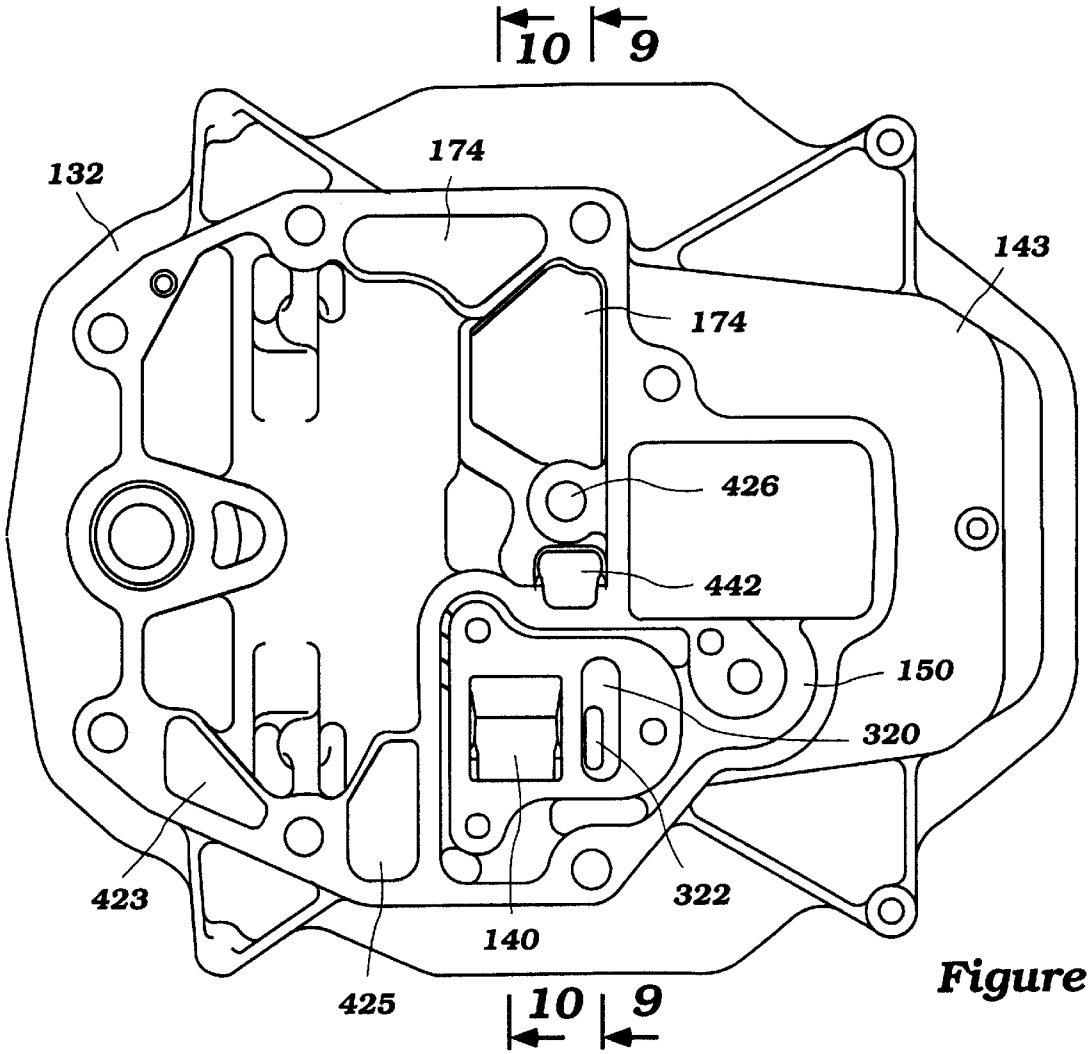
FIG. 17 is a bottom plan view showing the exhaust guide member.
Figure 18:
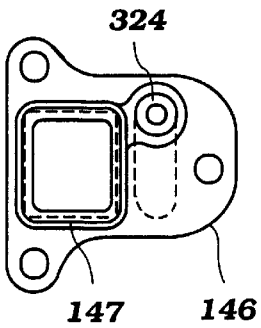
FIG. 18 is a bottom plan view showing an exhaust pipe assembly.
Figure 19:
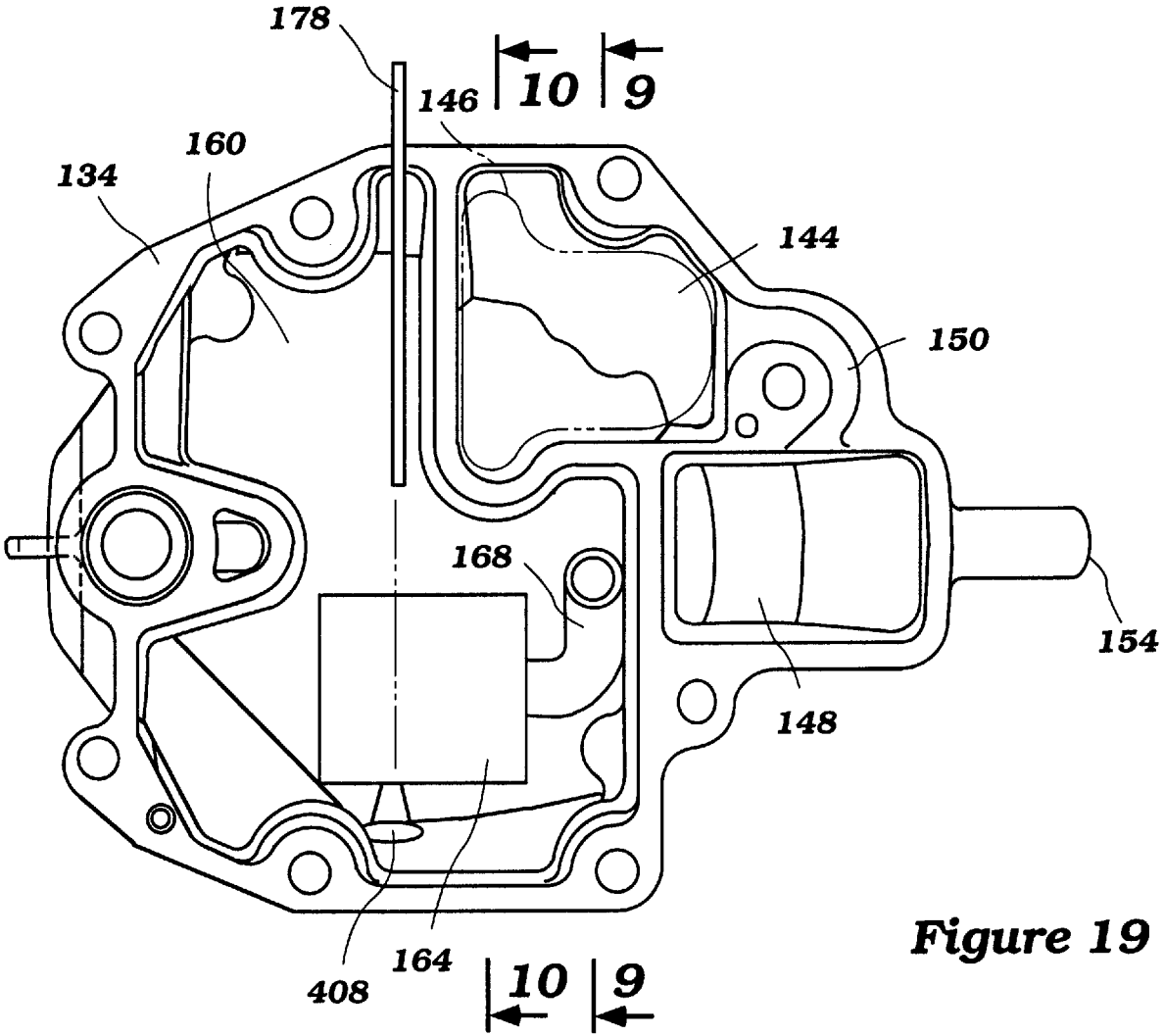
FIG. 19 is a top plan view showing an upper housing section of the driveshaft housing. The exhaust pipe assembly is indicated in phantom.
Figure 20:
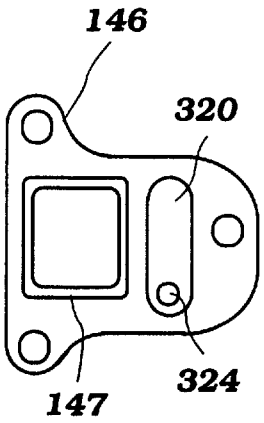
FIG. 20 is a top plan view showing the exhaust pipe assembly.
Figure 21:
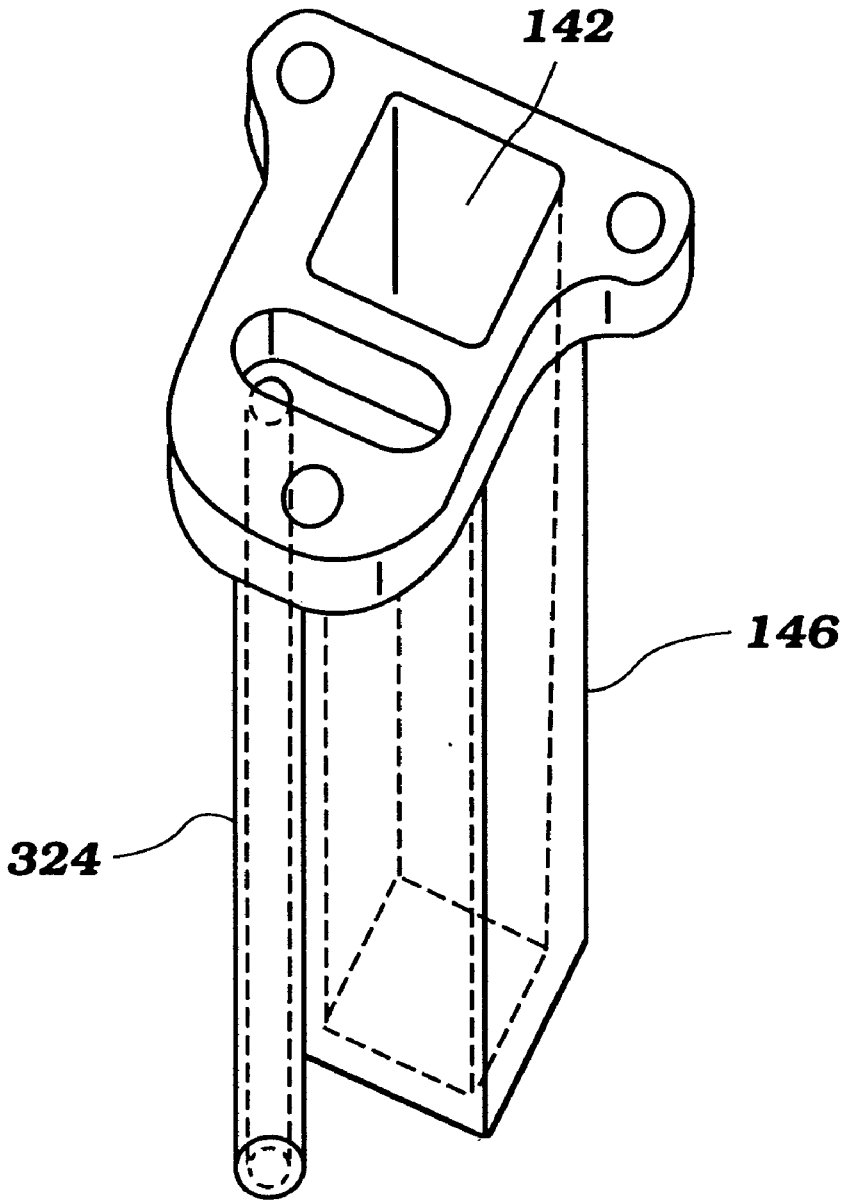
FIG. 21 is a perspective view showing the exhaust pipe assembly.

As best seen in FIG. 4, an idle exhaust expansion chamber 148 is also defined between the exhaust guide member 132 and the upper housing member 134. As seen in FIGS. 4, 17 and 19, an idle exhaust passage 150 is formed between the guide member 132 and the upper housing member 134. The idle exhaust passage 150 joins the idle exhaust expansion chamber 148 with the upper exhaust section 144. The idle expansion chamber 148, in turn, has an idle exhaust gas discharge port 154 at its rear portion. Thus, exhaust gasses from the combustion chambers 60 at idle speed go to the idle expansion chamber 148 from the upper exhaust section 144 through the idle exhaust passage 150. Then, the idle exhaust gasses are discharged to the atmosphere through the discharge port 154. Since the idle exhaust gasses are expanded in the idle expansion chamber 148, exhaust noise is sufficiently reduced.

Figure 11:
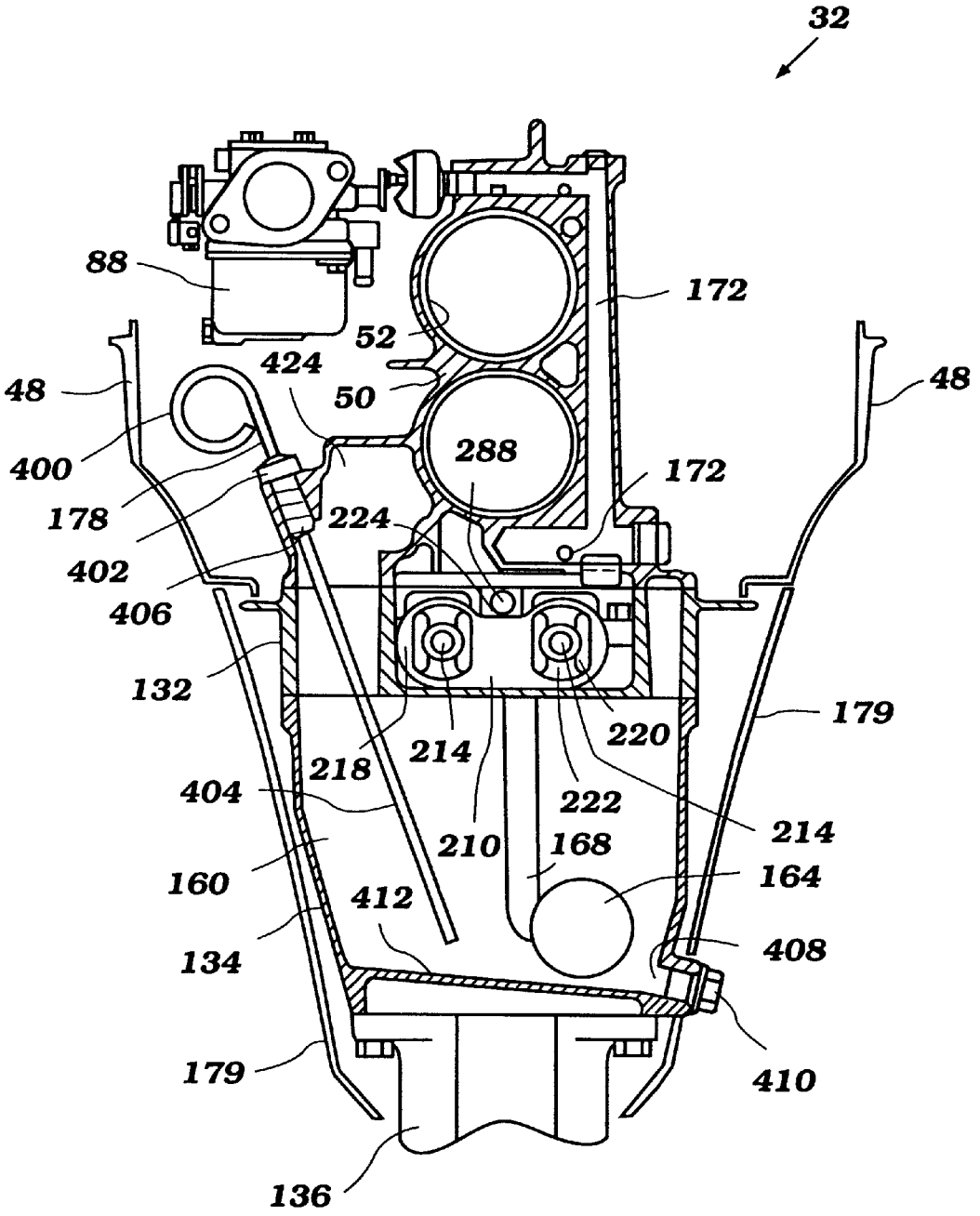
FIG. 11 is an enlarged, cross-sectional front view showing the power head, the exhaust guide and the upper part of the driveshaft housing. The cross-sectioned area in this figure is different from those of the former two figures and the exhaust guide member is sectioned along the line 11—11 in FIG. 16.
Figure 12:
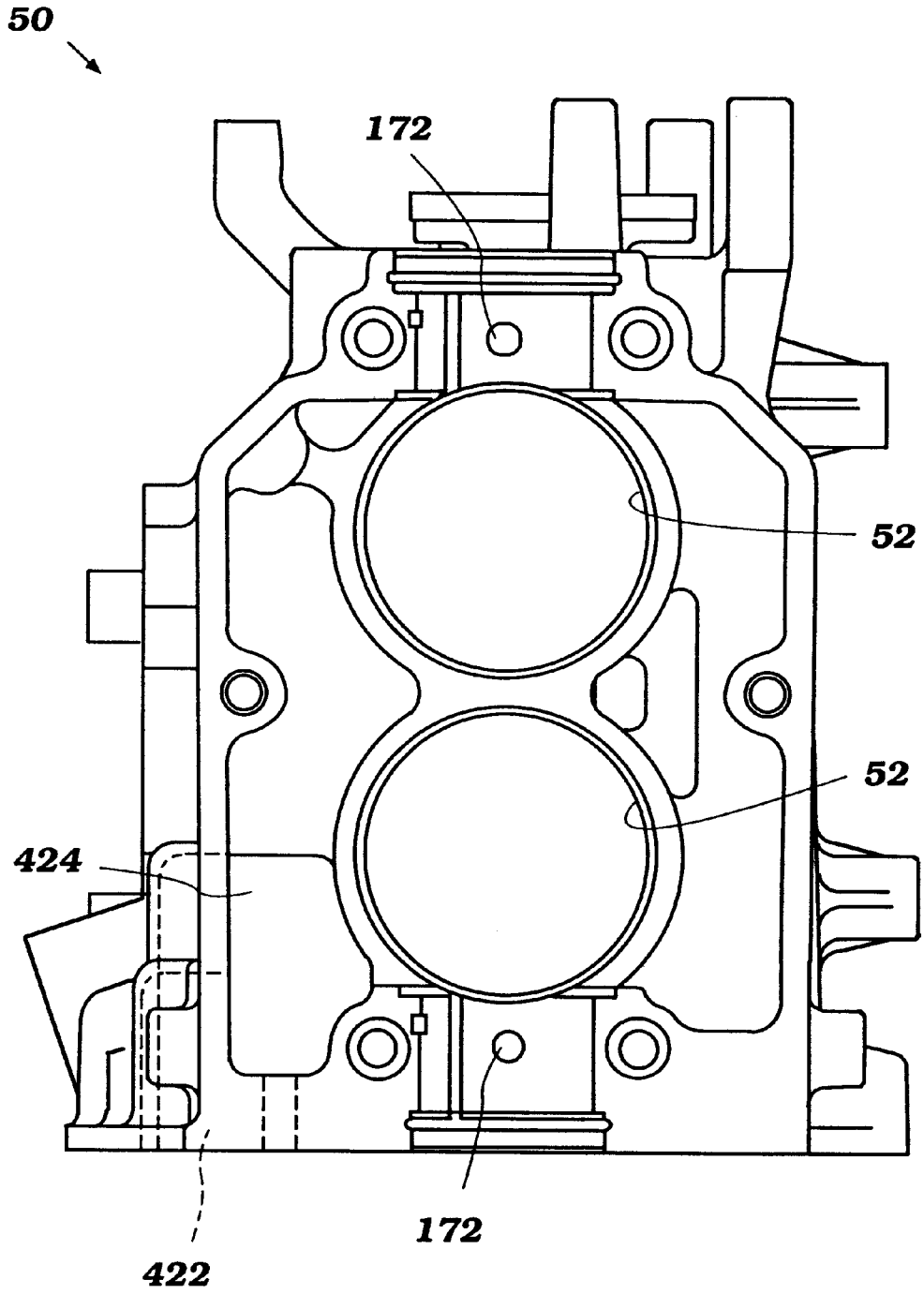
FIG. 12 is a front view the cylinder block.
Figure 13:
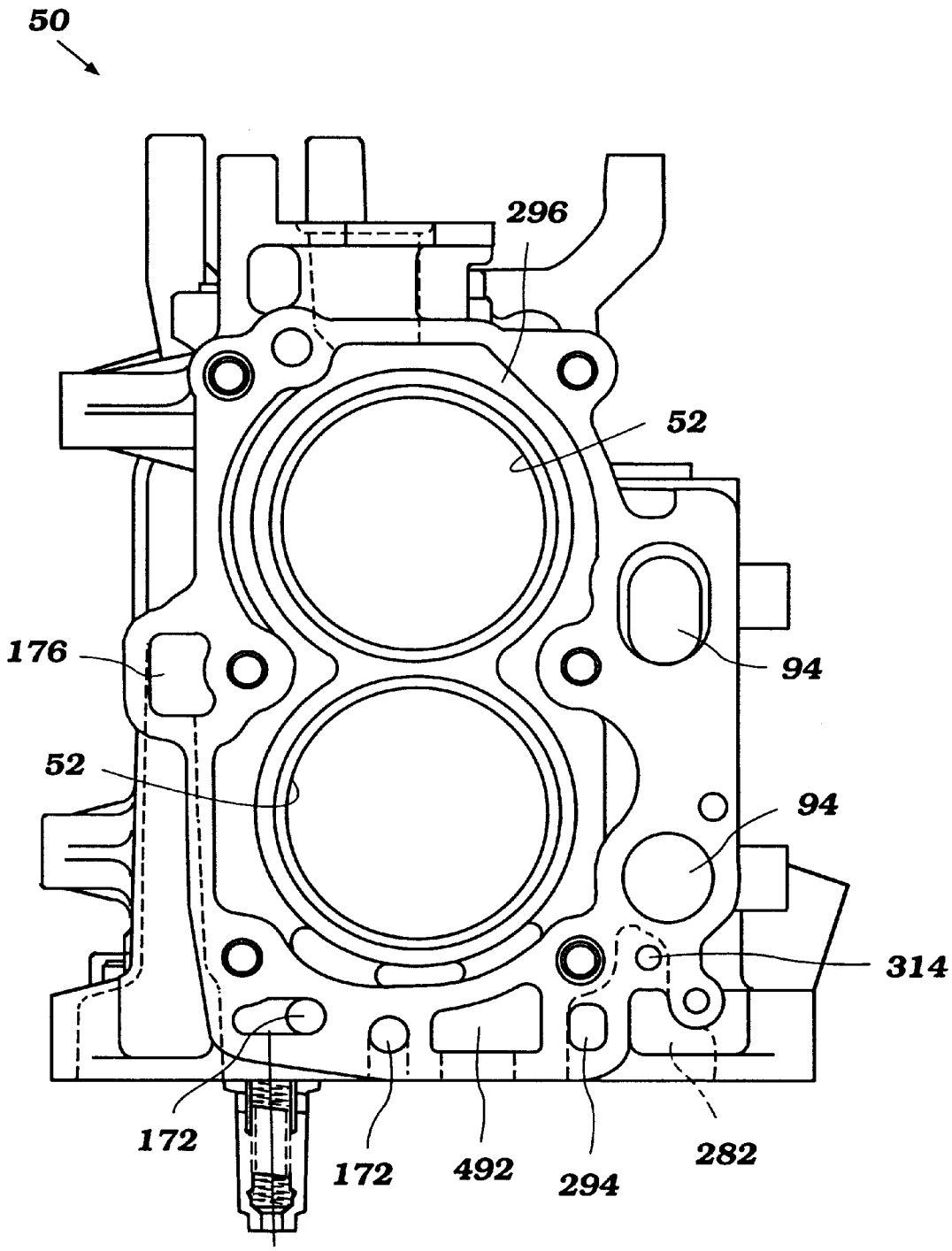
FIG. 13 is a rear view of the cylinder block.
Figure 14:
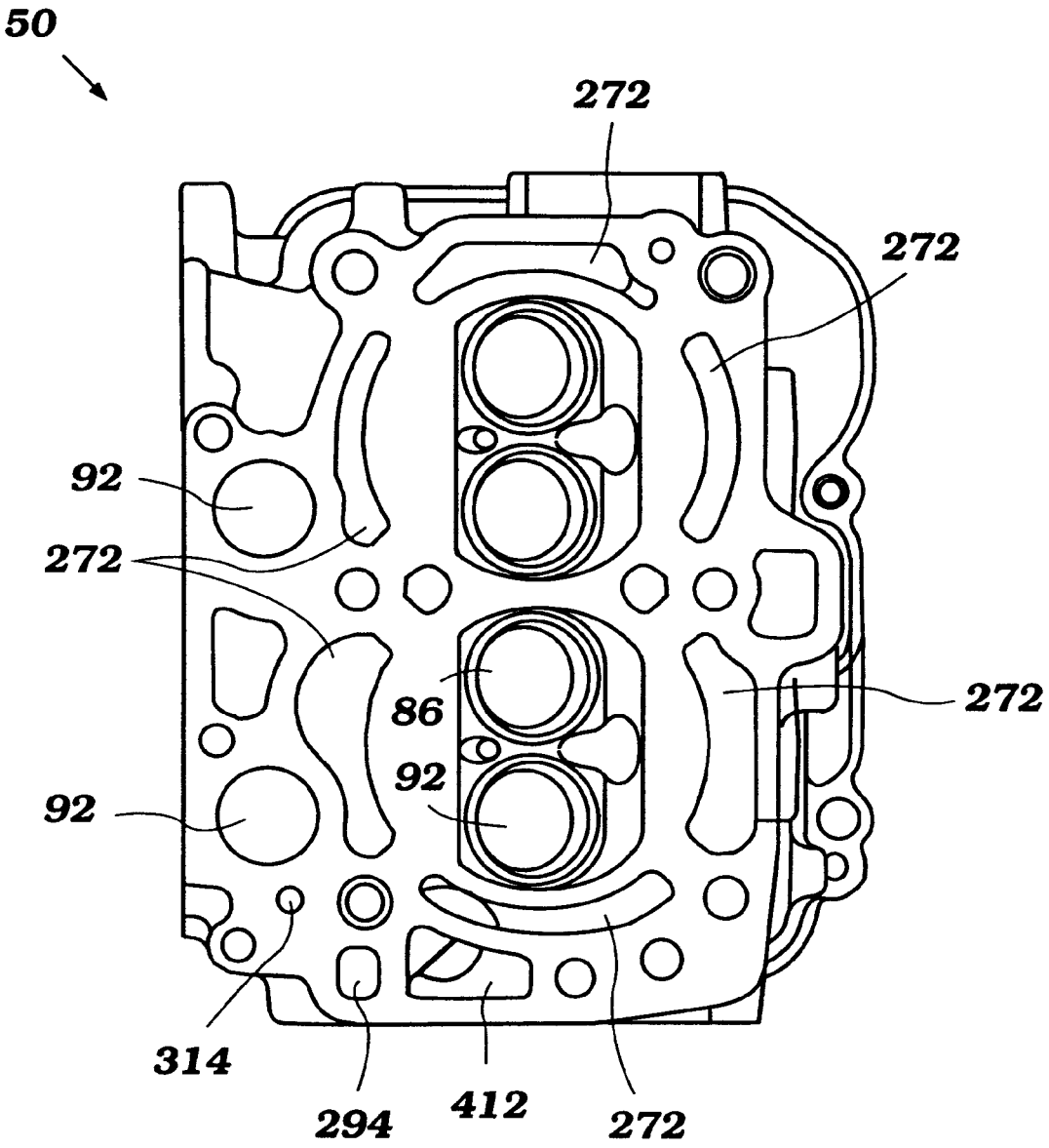
FIG. 14 is a front view showing the cylinder head.

With reference to FIGS. 3 and 11, a lubricant reservoir 160 is located below the engine 32, between the exhaust guide member 132 and the upper housing member 134 and is spaced apart from the upper exhaust section 144 and the idle exhaust expansion chamber 148 by a partition wall 162. The reservoir 178 includes an insertion port 406 that is located below the carburetor 88. A grip of a dip stick 178 is located in the space between the carburetor 88 and the insertion port 406. By inserting an elongated portion 404 of the dip stick 178 into the reservoir 160, the dip stick 178 can be used to measure the volume of lubricant in the reservoir 160. The dip stick 178 also includes a cap 402 which seals the reservoir 160 and holds the dip stick 178 in place during operation of the motor 30.

The reservoir 160 also includes a drain 408, which is covered by a cap 410. The drain is used to remove lubricant from the reservoir 160. The bottom surface 412 of the reservoir 160 is inclined downwards towards the drain 408. Accordingly, when the cap 410 is removed the lubricant drains smoothly towards the drain 308. As best seen in FIG. 11, the drain 308 is located on a side of the reservoir 160 opposite the insertion port 406. Therefore, when the outboard motor 30 is tilted up and on its side for storage, the drain 30 is located at the bottom of the motor 30. The lubricant can be easily drained from the reservoir 160 during storage.

A suction pipe (not shown) may also be used to remove lubricant from the reservoir 160. To remove the lubricant, the dip stick 178 is removed and the suction pipe is inserted into the insertion port 406. An advantage of the present invention is that from a top plane view an axial line that runs through the insertion port 406 is directed towards the drain 308. Thus, when the suction pipe is inserted into the reservoir 160 the port 406 guides the pipe towards the drain. The incline surface 412 also helps to guide the tip of the suction pipe towards the drain. The pipe therefore is directed to the lowermost point of the reservoir 160. Accordingly, can almost all of the lubricant can be removed.

Figure 6:
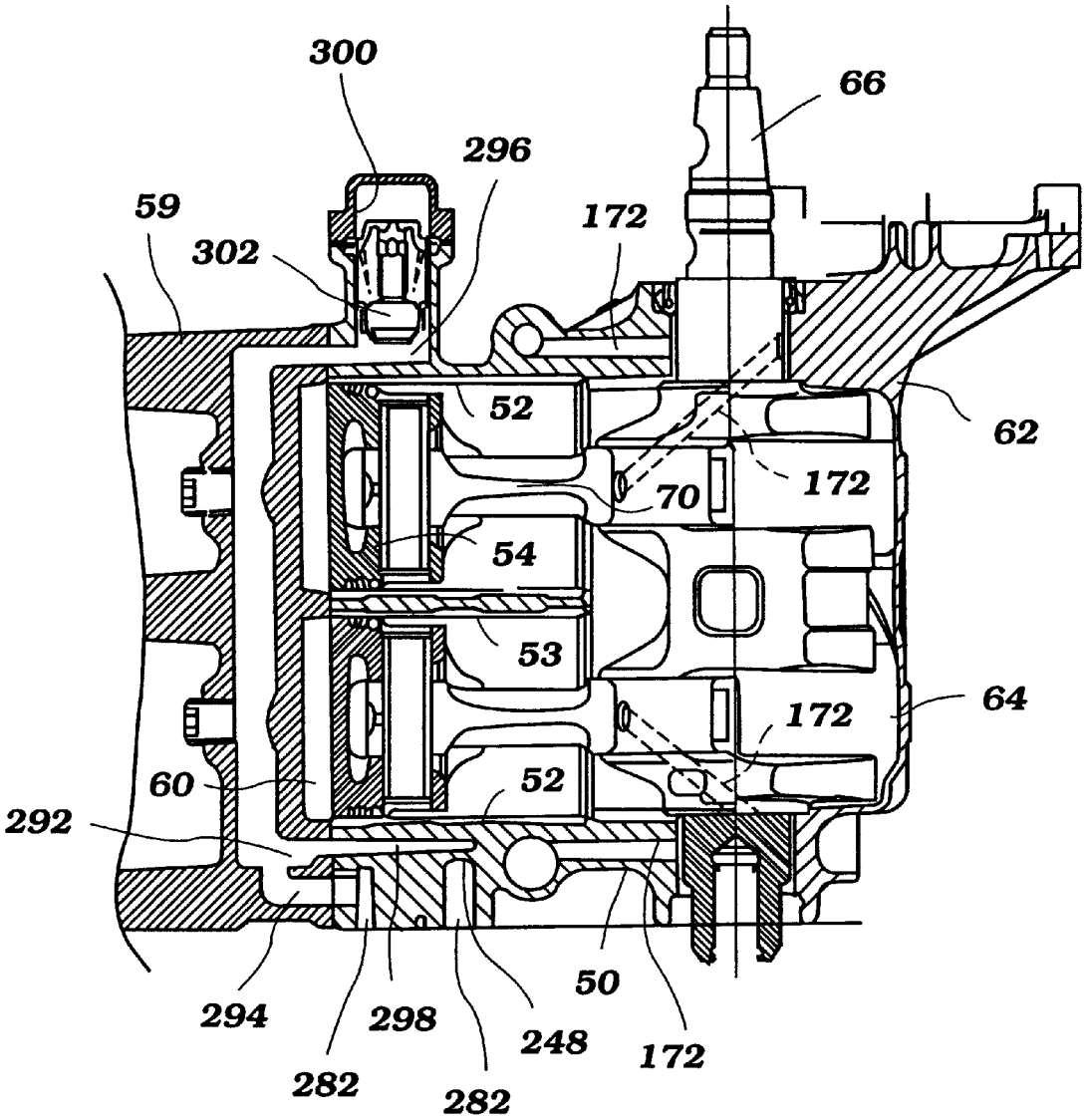
FIG. 6 is a cross-sectional side elevational view showing the engine. The cylinder head is partially cut away. A cooling jacket and passages are schematically illustrated to indicate some portions that are not in this cross-section.

The lubricant reservoir 160 also includes an lubricant filter or strainer 164 and a lubricant supply pipe 168 extending upwardly from the lubricant filter 164. The lubricant pipe 168 is connected to lubricant intake passage 426 (see FIG. 9), which extends through the exhaust guide 132. The intake passage 426 is connected to a lubricant pump 170 (FIG. 3), which is affixed to and driven by the lower end of the camshaft 100. As seen in FIGS. 3 and 6, the lubricant pump 170 is connected to lubricant supply passages 172. The lubricant passages 172, in turn, have access to, for example, the crank chamber 64 where the crankshaft 66 is journaled or is connected with the connecting rods 70. When the lubricant pump 170 is driven by the camshaft 100, the lubricant in the lubricant reservoir 160 is drawn up through the lubricant filter 164 and the lubricant pipe 168 to the lubricant pump 170 and then delivered to the engine portions that are required to be lubricated through the respective lubricant passages 172. After lubrication, the lubricant returns to the lubricant reservoir 160 by its own weight through return passages which are not shown.

As mentioned above, lubricant is supplied to the crank chamber 64 by lubricant passages 172. The lubricant is sprayed into the crank chamber 64 to lubricate the connection between the crankshaft 66 and the connecting rods 70 (see FIG. 8) as is well known in the art. The lubricant that is sprayed in to the crank chamber 64 is deposited on the inner surface 428 of the crank chamber 64 because of the air flow generated by the revolution of the crankshaft 66. The lubricant collects at the bottom of the crank chamber 64. In the prior art, an oil return passage is located on the bottom surface 430 of the crank chamber 64. The oil return passage returns the oil to the oil reservoir 160.

Figure 22:
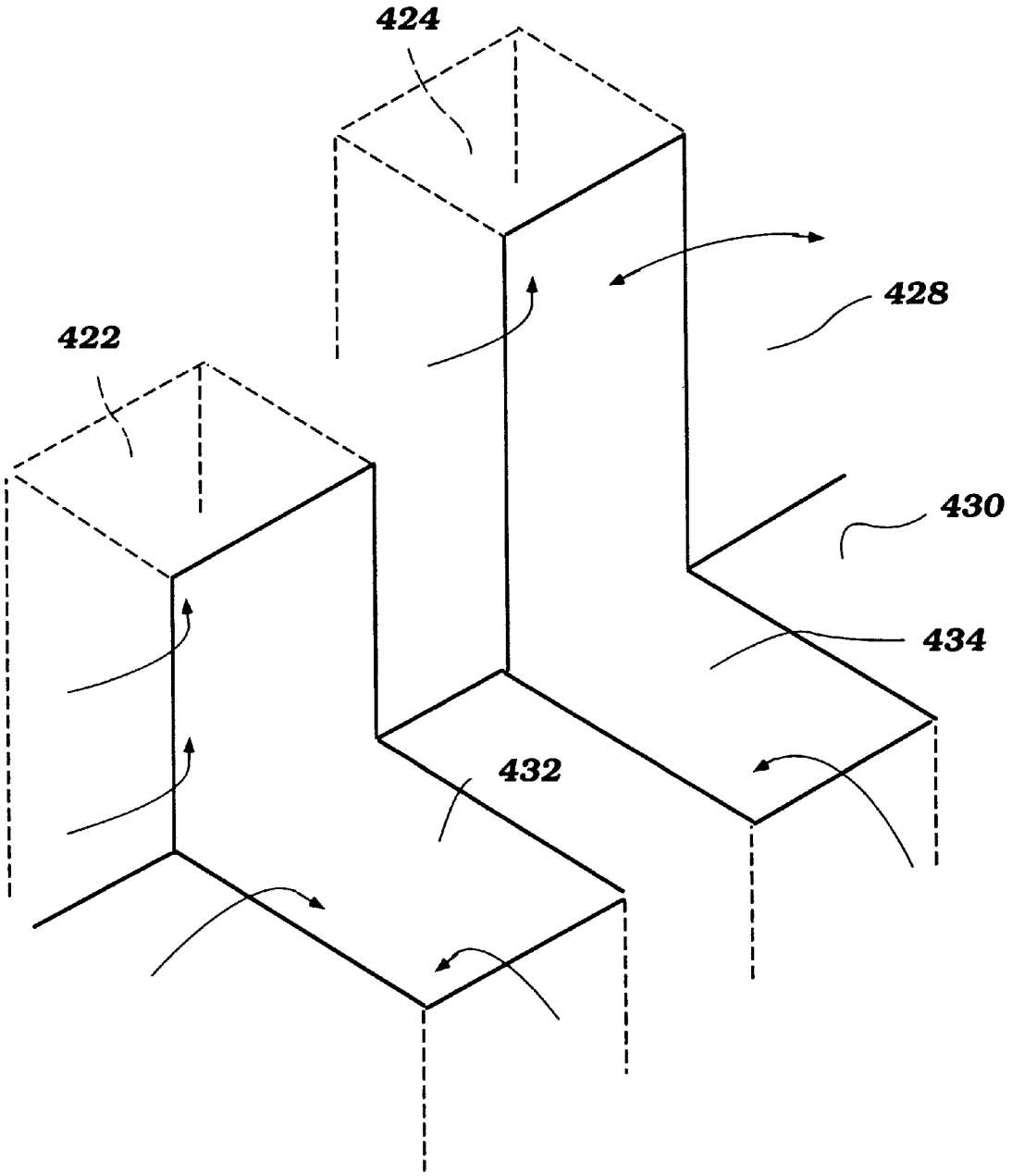
FIG. 22 is a schematic view of crank chamber lubricant return passages according to the present invention.
Figure 23:
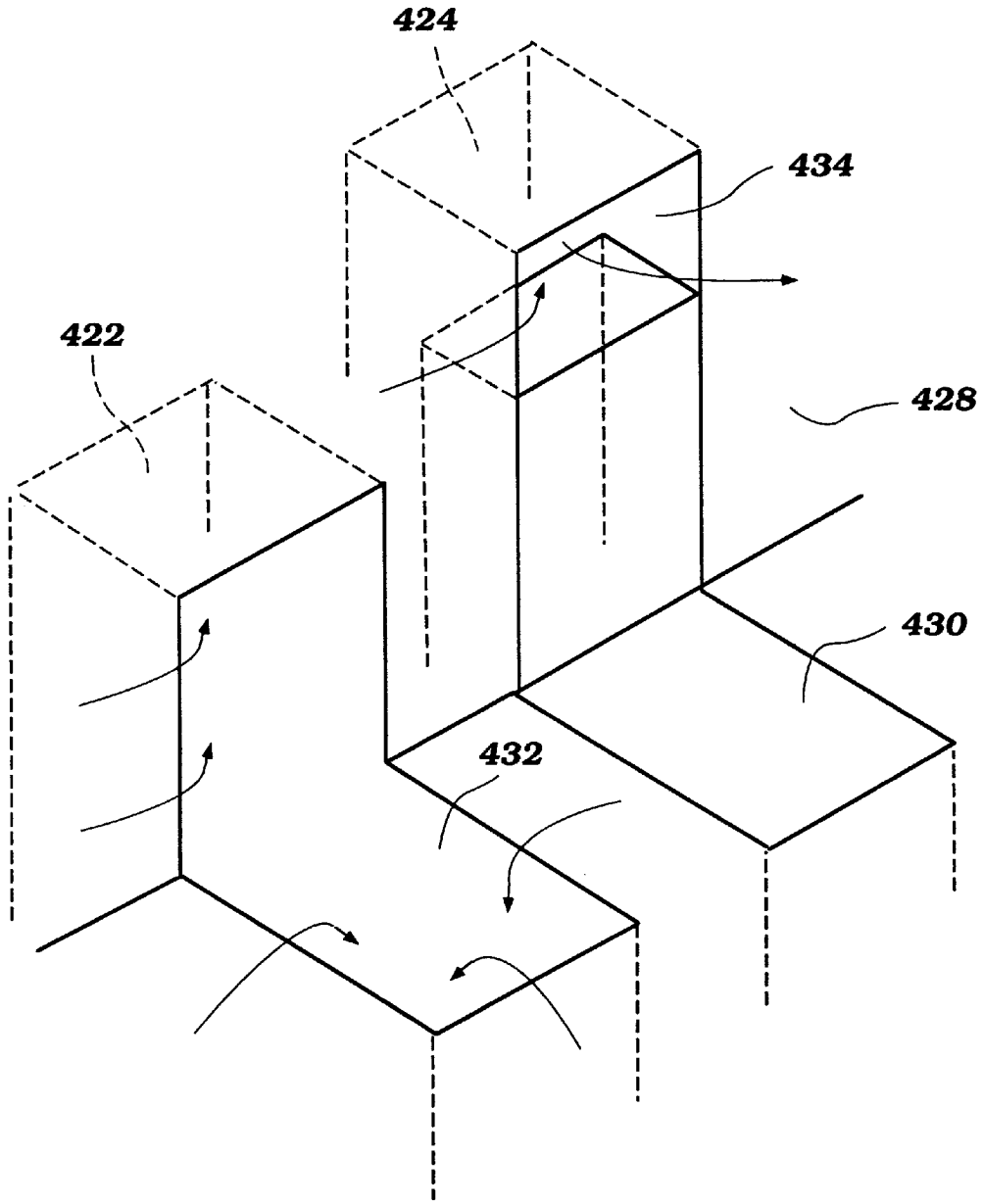
FIG. 23 is a schematic view of another arrangement of crank chamber lubricant return passages according to the invention.

According to the present invention, the outboard motor 130 includes two crank chamber oil return passages 422, 424 that are best seen in FIGS. 8, 22, and 23. The front return passage 422 has an opening 432 that is located on both the inner surface 428 and the bottom surface 430 of the crank chamber 64. Similarly, the rear return passage 424 has an opening 434 that is located on both the inner surface 428 and the bottom surface 430 of the crank chamber 64. As seen in FIG. 22, the rear return passage 424 preferably extends farther up the inner surface 428 of the crank chamber 64 than the front return passage 422.

This arrangement of the oil return passages 422, 424 has several advantages over the prior art arrangements. For example, because the return passages 422, 424 are opened to both the inner and bottom surfaces 428, 430 of the crank chamber 64, the lubricant that collects along the inner surface 428 and the bottom surface 430 can flow more easily down the return passages 422, 424. Accordingly, lubricant can more quickly return to the reservoir 160 as compared to prior art return passages. Furthermore, because the height of the rear passage 424 is preferably higher than the lubricant collected at the bottom surface 430, interference between vapors and gas and the lubricant is minimized. That is, vapors tend to flow towards the higher return passage and lubricant tends to flow towards the lower return passage. Thus, the rear passage 424 provides a breather passage between the crank chamber 64 and the oil reservoir 160.

Figure 16:
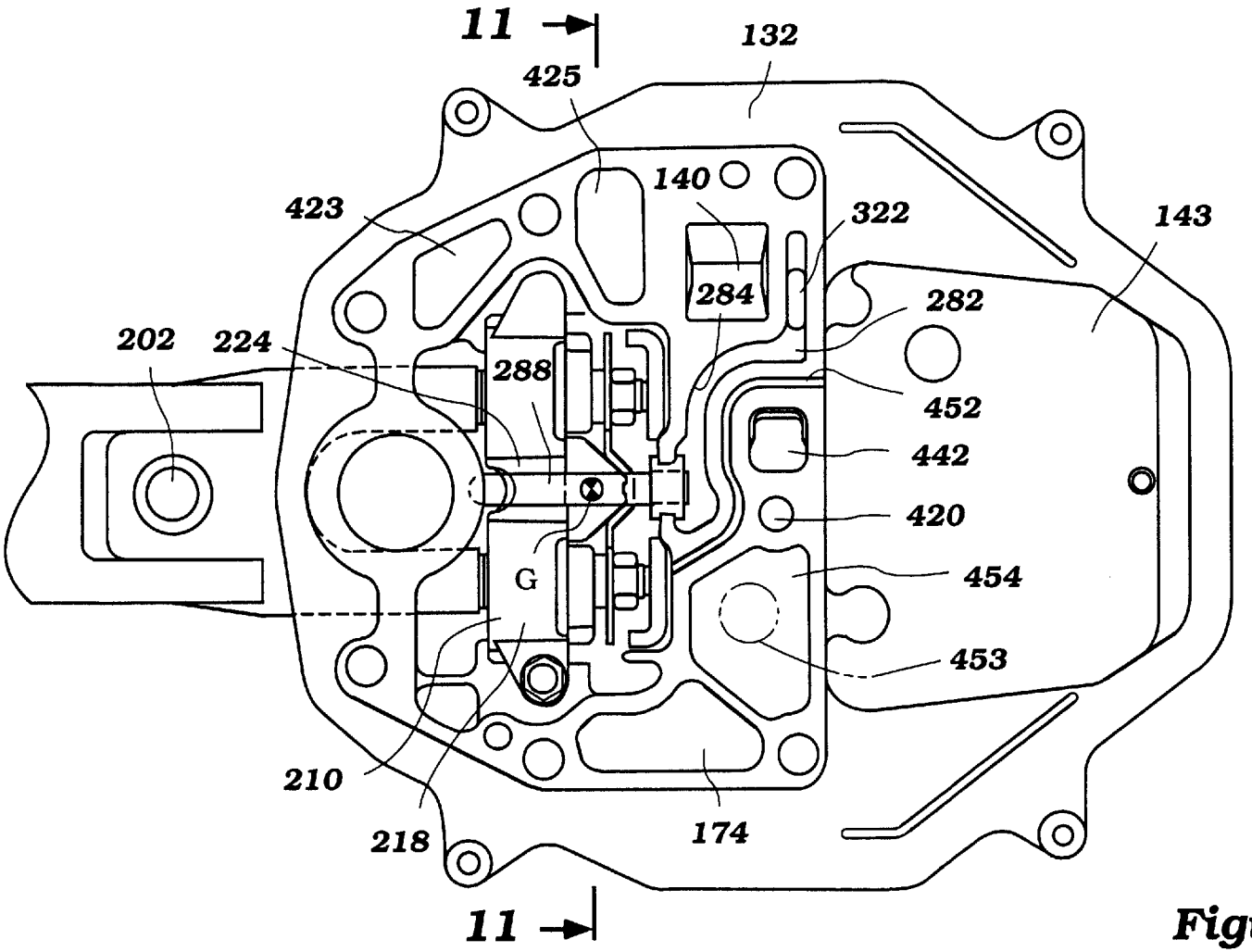
FIG. 16 is a top plan view showing the exhaust guide member.

As best seen in FIGS. 11, 16 and 17, the crank chamber return passages 422, 424 extend though return holes 423, 425 formed in the exhaust guide 132. The return holes 323, 325 are preferably located on the same side of the reservoir 160 as the insertion port 406. More preferably, the insertion port 406 is formed in at least one of the return passages 422, 424. In the illustrated arrangement, the insertion port 406 is formed in the rear return passage 424. This arrangement simplifies the manufacturing of the reservoir 160. The return passages 422, 424 are also located on the same side of the engine 32 as the induction and exhaust passages. Accordingly, when the engine is stored with side up the return passages 422, 424 are located on the upper side of the engine. Thus, lubricant does not accumulate inside the crank chamber 64 during storage because the return passages 422, 424 will be located above the lubricant level in the reservoir 160.

FIG. 23 illustrates an alternative arrangements of the return passages 422, 424. In this arrangement, the rear return passage 424 is located completely above the front return passage 422. This arrangement ensures that interference between the vapors and the lubricant does not prevent the flow of lubricant to the reservoir 160.

Figure 9:
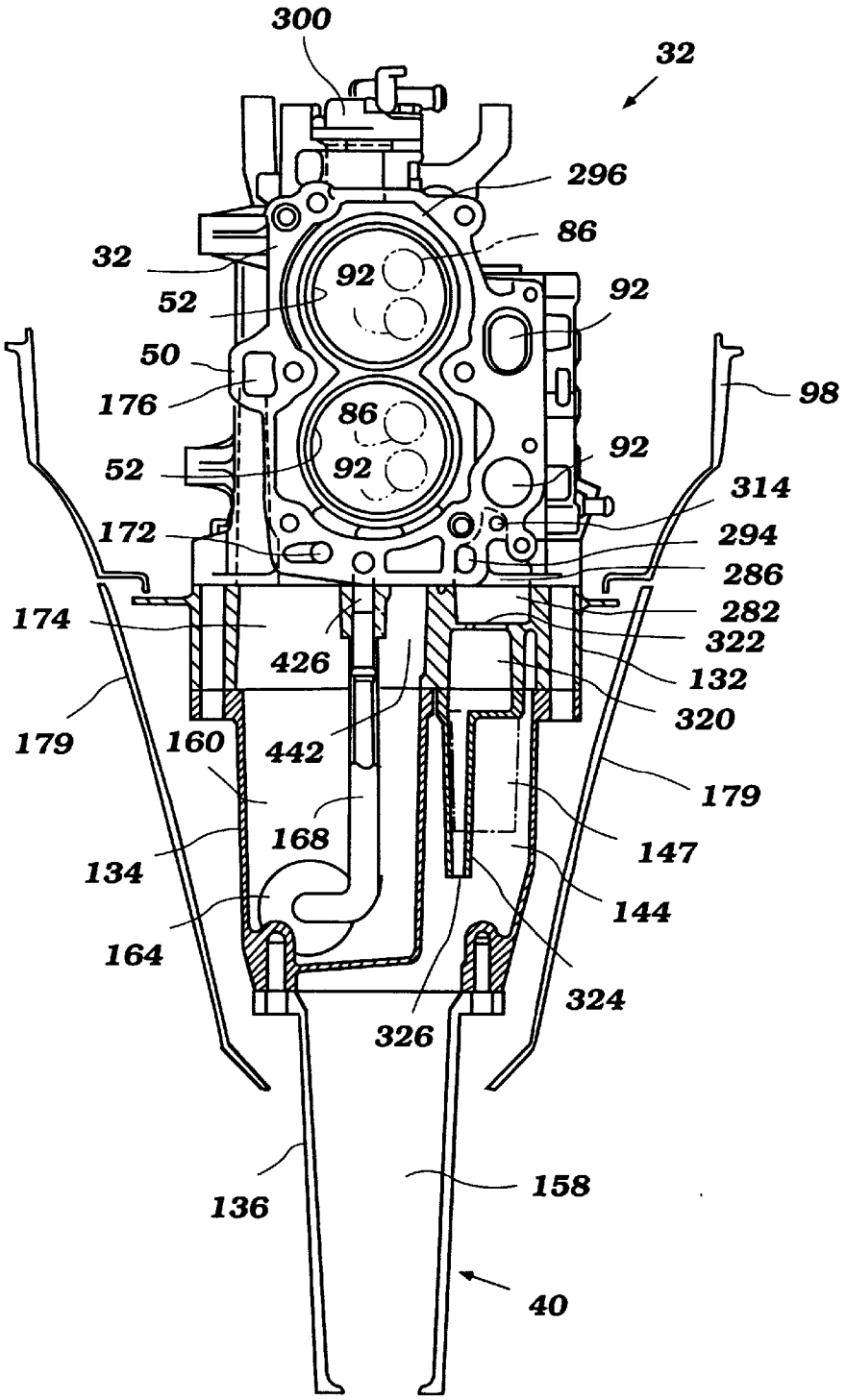
FIG. 9 is a cross-sectional rear view showing the power head, an exhaust guide member and the driveshaft housing. The exhaust guide member and driveshaft housing are sectioned along the line 9—9 in FIGS. 17 and 19. The engine is not sectioned.

As shown in FIGS. 8 and 10, vapor or gaseous lubricant in the lubricant reservoir 160 can flow into the camshaft chamber 108 (FIG. 8) through breather passages 174, 176 formed within the exhaust guide member 132 and cylinder body 50, respectively. As best seen in FIG. 10, the breather passages 174, 176 are located on a side opposite the exhaust manifold 94 and the induction system 76. Accordingly, there is sufficient space to form these passages. The camshaft chamber 108 communicates with a vapor separator 440. As shown in FIG. 7, the vapor separator 440 108 further communicates with the air intake section 80 by a breather pipe 177. Accordingly, the vapor can be combusted in the combustion chamber. Lubricant is returned to the reservoir 160 through a return passage 442 (FIG. 9).

As seen in FIG. 10, the lubrication system also includes a relief valve 453. The relief valve 453 lies in a relief valve through hole 454, which is formed in the exhaust guide 132 (see FIG. 16). The relief valve 453 to the internal passages 172 and discharge excess pressure in the lubrication system as is well-known in the art.

An apron 179, which is best seen in FIG. 3, is made of synthetic resin and encloses both sides and the rear of the exhaust guide member 132 and the upper housing member 134. The apron 179 is detachably affixed to the upper housing member 134. The apron 179 is not a structural member and is provided only for a good and neat appearance of the outboard motor 30. It can be produced with a low cost relative to a member made of metal material.

As seen in FIGS. 3, 9, 10 and 20, the lubricant reservoir 160 is placed forward of the overhanging rear portion 143 of the exhaust guide member 132. The reservoir 160 is heavy when it is filled with lubricant. However, the heavy reservoir 160 is not supported on the rear portion 143. The rear portion 143 thus does not need to be reinforced to support the heavy reservoir 160. In order to provided sufficient capacity, the lubricant reservoir 160 fully extends transversely in order to maximize its size, With reference to FIG. 2, the lower unit 42 depends from the driveshaft housing 40, specifically the lower housing member 136, and supports a propeller shaft 180 which is driven by the driveshaft 128. The propeller shaft 180 extends generally horizontally through the lower unit 42. In the illustrated embodiment, the propeller shaft 180 drives a propeller 182 that is affixed to an outer end of the propeller shaft 180.

A transmission 184 is provided between the driveshaft 128 and the propeller 182. The transmission 184 couples together the drive shaft 128 and the propeller shaft 180, which lie generally normal to each other (i.e., at a 90° shaft angle) with, for example, a bevel gear combination. The transmission 184 has a switchover mechanism 186 to shift rotational directions of the propeller 182 to forward, neutral or reverse. The switchover mechanism 186 includes a dog clutch and a shift cable disposed in the protective cowlings 46, 48. A shift rod assembly 188, which extends generally vertically, is also included in the switchover mechanism 186 to connect the dog clutch with the shift cable. The shift cable extends forwardly from the protective cowlings 46, 48 so as to be operated by the operator. In the illustrated embodiment, the shift rod assembly 188 extends through a swivel bracket, which will be described shortly, and into the lower unit 42.

With continued reference to FIG. 2, the lower unit 42 also defines an internal passage that forms a discharge section 190 of the exhaust system 78. The discharge section 190 of the lower unit 42 and the aforenoted upper and lower exhaust sections 144, 158 of the driveshaft housing 40 define an exhaust expansion chamber. At engine speed above idle, the majority of the exhaust gasses are discharged to the body of water surrounding the outboard motor 30 through the discharge section 190 and finally through a hub 192 of the propeller 182, as is well known in the art.

The bracket assembly 36 comprises a swivel bracket 196 and a clamping bracket 198. The swivel bracket 196 supports the drive unit 34 for pivotal movement about a generally vertically extending steering axis 200 which is an axis of a steering shaft 202 affixed to the driveshaft housing 40. The steering shaft 202 extends through a hollow 206 made within the swivel bracket 196. The steering shaft 202 itself has a hollow 208 and the aforenoted shift rod assembly 188 extends therethrough.

The steering shaft 202 is affixed to the driveshaft housing 40 by an upper mount assembly 210 and a lower mount assembly 212. As seen in FIGS. 11 and 16, the upper mount assembly 210 comprises a pair of rods 214 affixed to the steering shaft 202, a mount member 218 having a pair of tubular sections 220 through which the rods 214 are inserted and elastic members 222 interposed between the tubular sections 220 and the rods 214. A recess 224 is formed at an upper surface of the mount member 218 between the tubular sections 220. The upper mount 210 is mounted in the exhaust guide 132. Preferably, in a top lane view, the center of gravity of the maid body of the outboard motor 30 lies at substantially the same level as the upper mount. This arrangement minimizes vibration of the outboard motor 30. The lower mount assembly 212 has a similar structure except the recess 224.

A steering bracket 228 extends generally upwardly and then forwardly from the steering shaft 202. A steering handle 230 is pivotally affixed onto the steering bracket 228. That is, as seen in FIG. 1, the steering handle 230 can take a working position shown in actual line and a folded-up position shown in phantom line by a pivotally shiftable folding mechanism 232. When the steering handle 230 is folded up, it extends along the port side wall of the top cowling 46. The operator can steer the outboard motor 30 when the steering handle 230 is in the working position. A throttle control lever may be also attached to the steering handle 230. The opening degree of the throttle valves in the carburetors 88 are remotely controlled by the throttle control lever.

The clamping bracket 198 is affixed to the transom 37 of the associated watercraft 38 and supports the swivel bracket 196 for pivotal movement about a generally horizontally extending tilt axis, i.e., the axis of a pivot shaft 238. The clamping bracket 198 includes a pair of members spaced apart laterally from each other. A thrust pin 240 is transversely provided between the spaced members. A lower front portion of the swivel bracket 196 contacts the thrust pin 240 and conveys thrust force by the propeller 192 to the associated watercraft 38.

Although a hydraulic tilt system can be provided between the swivel bracket 196 and the clamping bracket 198, this exemplary outboard motor 30 has no such system. The operator, therefore, tilts the motor 30 up or down for himself or herself. When the operator wants to hold the outboard motor 30 at the tilted up position, he or she may use a tilt pin (not shown) in a manner which is well known in the art.

The engine and its induction and exhaust systems will now be described in detail. Because the air induction system 76 and the exhaust system 78 are disposed on the same side of the engine 32, it is difficult to make the engine component. The problem is solved by employing the following arrangement in this embodiment.

Figure 5A:
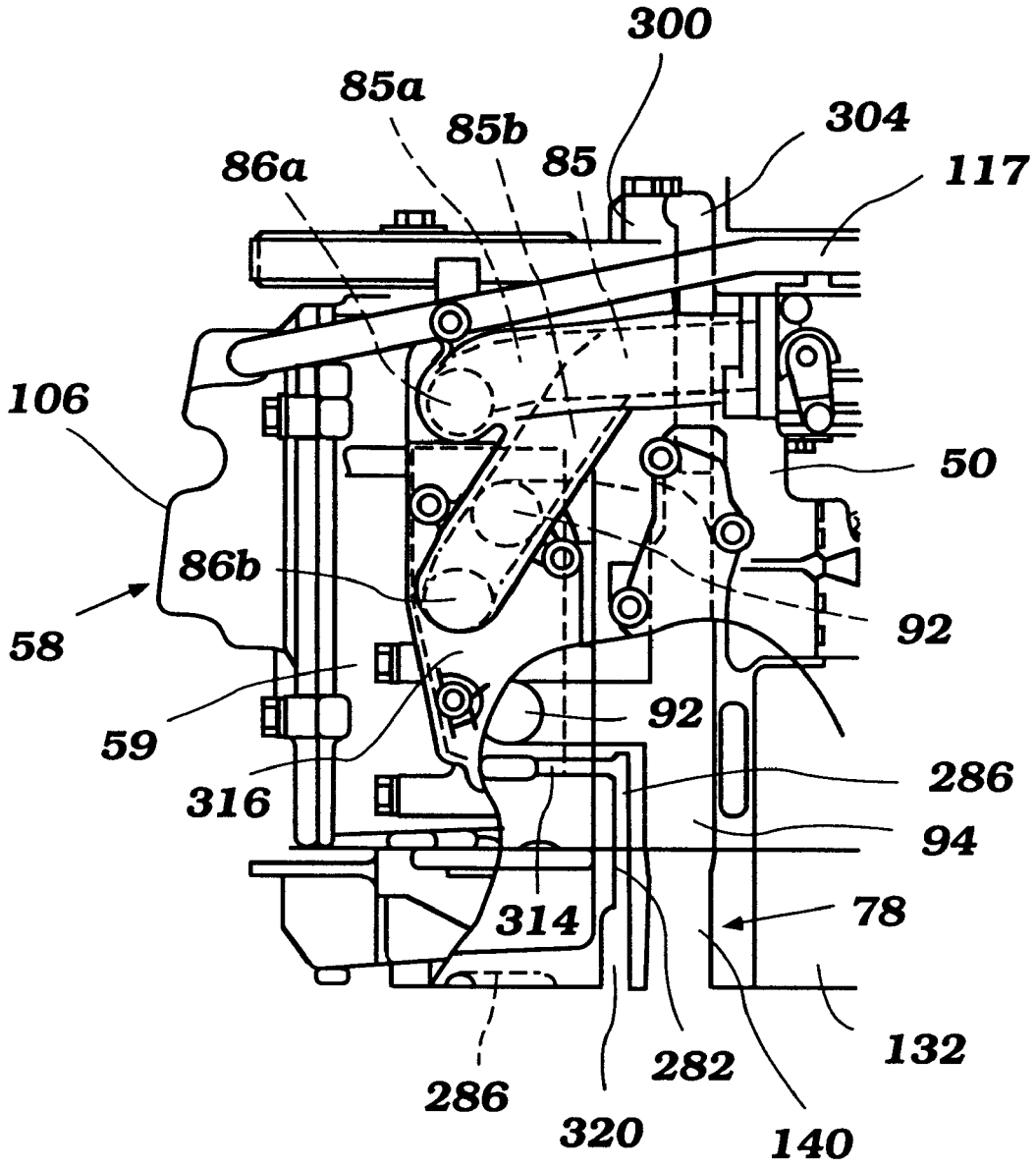
FIG. 5A is an enlarged sectional view showing the same power head. An intake and exhaust cooling jacket is indicated in dotted line.
Figure 5B:
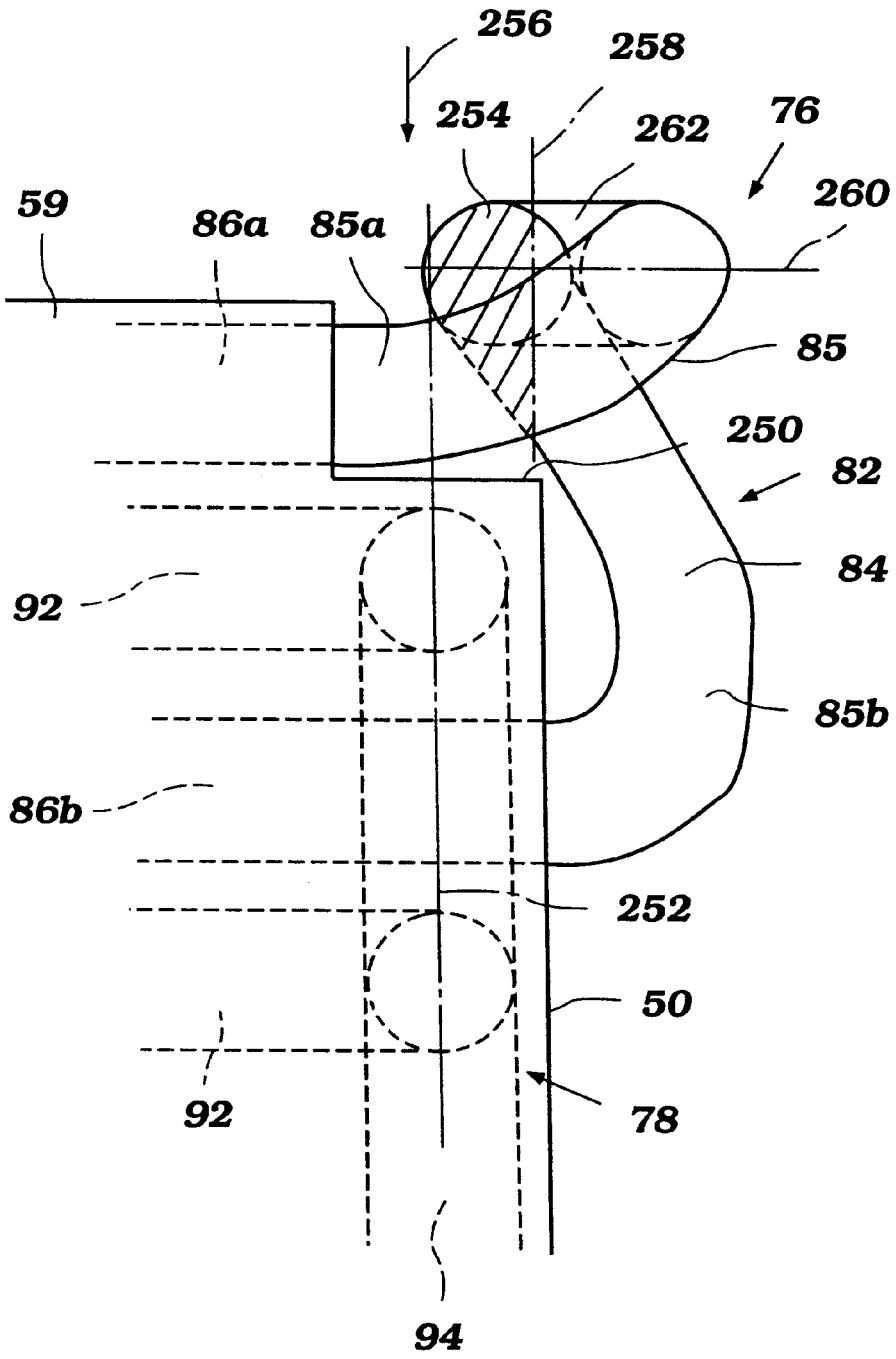
FIG. 5B is a schematic front view showing the arrangement of air passages and exhaust passages on the engine.

As best seen in FIGS. 5A and 5B, the exhaust manifold 94 extends generally along the cylinder body 50. In the illustrated embodiment, the exhaust manifold 94 is unified with the cylinder body 50 and has an upper end portion 250 in a direction of its axis 252. The exhaust manifold 94 communicates with the exhaust ports or exhaust passages 92 that extend from the cylinder head member 59 to the cylinder body 50. The lower intake port or inner portion 86*b* of the air intake passage 82 extends generally in between both exhaust ports 92 within the cylinder head member 59. Meanwhile, the upper intake port or inner portion 86*a* extends above the upper exhaust ports 92 within the cylinder head member 59. Both of the inner portions 86*a,* 86*b* are connected to the intake manifold 85 or intake runners 85*a,* 85*b*. The runner 85*b* has a passage portion 254 positioned adjacent to the end portion 250 of the exhaust manifold 94. The passage portion 254 is indicated with hatching in FIG. 5B. The passage portion 254 overlaps with the exhaust manifold 94 in the direction along the axis 252 of the exhaust passage, as viewed in the direction of arrow 256 of FIG. 5B, which aligns with the exhaust manifold axis. That is, the overlap exists to the left of the line 258 in the figure which extends from the outer end of the exhaust manifold 94.

The intake runners 85*a,* 85*b* of the air intake passages 82 are unified together at a unified portion 262 upstream of this overlap region of passage portion 254. Each intake runner 85*a,* 85*b* also extends between the overlap region and unified portion 262 such that this flow axes lie within a plan 260 that extends generally normal to the extending axis 252 of the exhaust manifold 94. The upper intake runner 85*a,* which is located nearer to the unified portion 262 than the lower intake runner 85*b,* is joined to the unified portion 262 at a position farther than that position at which the lower intake runner 85*b* is joined. In other words, both of the upper and lower outside sections 85*a,* 85*b* are crossed with each other.

The intake runners 85*a,* 85*b* unified together are aligned generally horizontally. That is, they are disposed side by side. Because of this arrangement, fuel may equally accumulate within both of the intake runners 85*a,* 85*b,* if any. Accordingly, an imbalanced delivery of fuel will not occur. In addition, upstream portions of the intake runners 85*a,* 85*b* are higher than downstream portions thereof. Thus, all of the deposited fuel, if any, will flow toward the combustion chambers 60 and not to the carburetors 88.

Since the passage portion 254 of the lower intake runner 85*b* is overlapped with the exhaust manifold 94 as described above, the air induction system 76 does not project so much from the cylinder head member 59 and cylinder body 50. Thus, even though the engine 32 employs such a counterflow arrangement, it is compact.

In addition, because of the crossed unification of the upper and lower intake runners 85*a,* 85*b,* the upper intake runner 85*a,* which is positioned closer to the unified portion 262 than the other intake runner 85*b,* can be connected to the engine body with a sufficient length. Therefore, the upper intake runner 85*a* can have a relatively large curvature and air charges can flow smoothly therethrough.

The outboard motor 30 has a cooling system 272 (FIG. 2) to cool down primarily the engine 32, and in particular the cylinder body 50, the cylinder head assembly 58, and the exhaust system 78. Since the air induction system 76 has the inner sections or inner portions 86 in the cylinder head assembly 58, these sections are also cooled. This cooling system 272 will now be described below.

Figure 15:
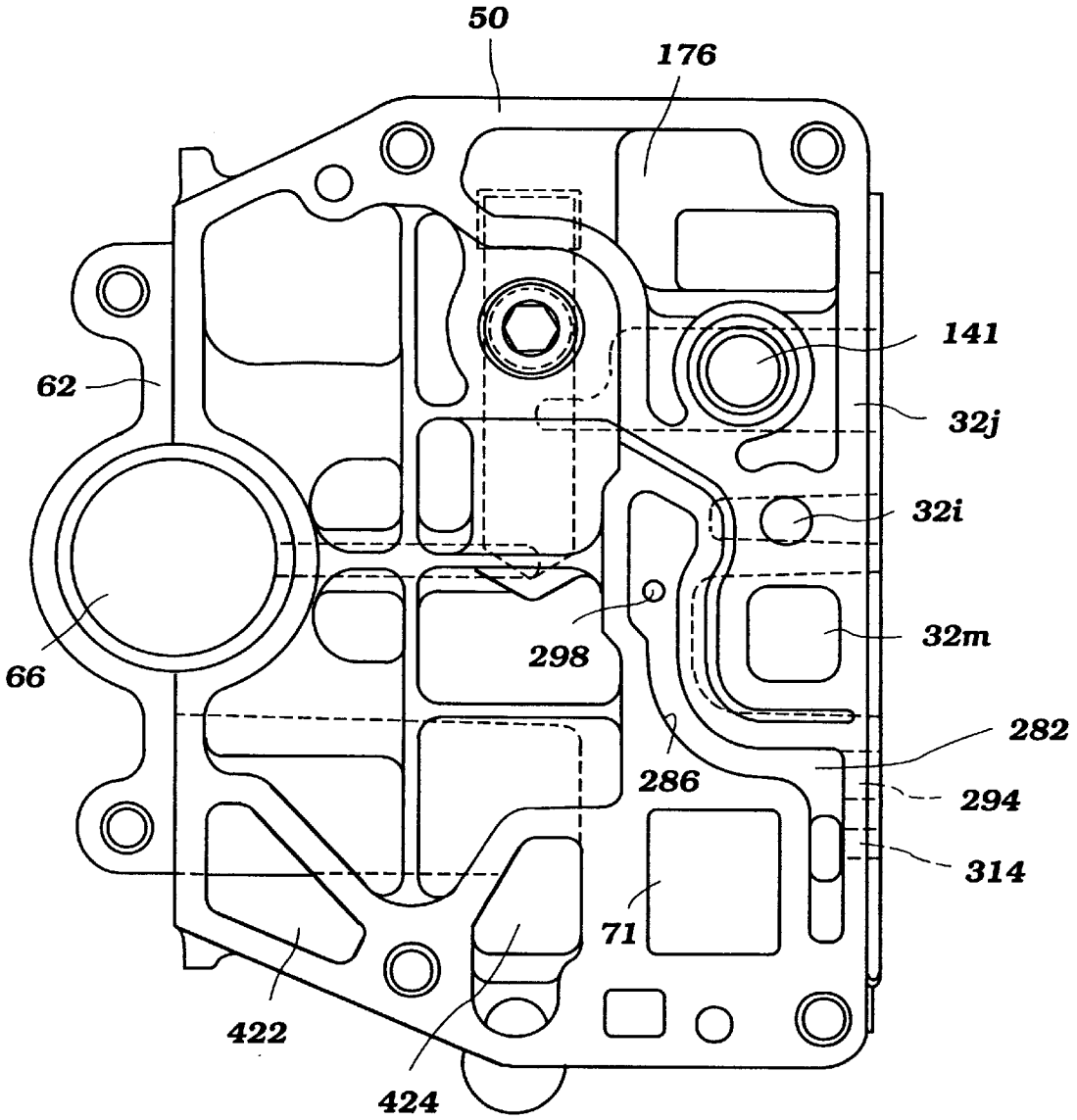
FIG. 15 is a bottom plan view showing a cylinder body and a crankcase member.

As shown in FIG. 2, the cooling system 272 draws water as coolant from the body of water surrounding the outboard motor 30. The cooling system 272 has a water inlet 274 disposed at a side of the lower unit 42 and a water pump 276 disposed at the lowermost portion of the lower housing member 136. A water inlet passage 278 is defined in the lower unit 42 and extends to the water pump 276 from the water inlet 274. As best seen in FIGS. 2, 15, and 16, water delivery passages 282 are defined between upper recesses 284 formed in the exhaust guide member 132 and lower recesses 286 formed in the cylinder body 50. This arrangement is beneficial because the coolant passages 282 are more easily manufactured as compared to prior art passages that are typically holes formed within the exhaust guide member 132. Also as shown in FIG. 16, the coolant passages 282 are formed around the periphery of the exhaust passage 140 so as to cool the exhaust passage 140. The coolant passages 282 are also located between the exhaust passages 140 and the lubricant inlet and return passages 442, 426. An escape channel 450 is located between the coolant passages 282 and the lubricant supply and return passages 442. The escape channel 450 prevents the cooling water from leaking and invading the lubricant passages 442. The pressure in the inlet lubricant passage 426 can become negative; therefore, the escape channels 450 are especially useful in preventing the coolant from entering the inlet passage 426.

The water pump 276 and the delivery passages 282 are connected with each other by a water supply pipe 288 (FIG. 2). The water supply pipe 288 extends generally vertically and makes a right-angled turn at its top portion. Then, as seen in FIGS. 11 and 16, the supply pipe 288 extends generally horizontally on the recessed portion 224 of the upper mount member 218. By extending the supply pipe 288 through the recessed portion 323, the vertical height of the engine is reduced. The water inlet 274, the water inlet passage 278, the water supply pipe 288 and the water delivery passages 282 together define a water delivery passage.

As best seen in FIG. 6, one of the delivery passages 282 in the cylinder body 50 is connected to a combustion chamber cooling jacket 292 in the cylinder head member 59 through a conjunction passage 294. The combustion cooling jacket 292 is disposed around the combustion chambers 60 to cool their peripheral wall portions. Another delivery passage 282 is connected to a cylinder body cooling jacket 296 through an orifice 298. The cylinder bore cooling jacket 296 generally surrounds the cylinder bores 52 to cool down their peripheral wall portions. Both of the combustion chamber cooling jacket 292 and the cylinder bore cooling jacket 296 are connected to each other and further connected to a thermostat chamber 300 placed atop of the cylinder body 50. A thermostat 302 is disposed in the thermostat chamber 300. The thermostat 302 is a coolant flow control mechanism and when water temperature is lower than a predetermined temperature it prevents water from flowing downstream.

As best seen in FIG. 10, an outlet of the thermostat chamber 300 is connected to a first discharge conduit 304. The first discharge conduit 304 is connected to a discharge jacket 306 defined in the cylinder body 50 and further to a second discharge conduit 308. The second discharge conduit 308 is lead to a space between the driveshaft housing 40 and the apron 179. The outlet of the second conduit 308 is opened to the space. In the illustrated embodiment, the combustion chamber cooling jacket 292, the conjunction passage 294, the cylinder body cooling jacket 296, the orifice 298, the thermostat chamber 300, the first discharge conduit, the discharge jacket 306 and the second discharge conduit 308 together define a first cooling water passage. The first cooling water passage, however, can comprise fewer or additional passages and conduits, but preferably flows through the cylinder body.

In addition, as seen in FIG. 8, a conjunction passage 314 is branched off from one of the water delivery passages 282 and is connected to an intake and exhaust cooling jacket 316. The conjunction passage 314 extends from the cylinder body 50 to the cylinder head member 59. As best seen in FIG. 5A, this cooling jacket 316 is disposed to overlap with the lower inner portion 86*b* and the both exhaust ports 92 but not overlap with the upper inner portion 86*a*. In other words, the cooling jacket 316 covers only outside of the lower inner portion 86*b* but not the upper inner portion 86*a*. A pilot water discharge pipe 318 (see FIG. 8) extends from the inlet and exhaust cooling jacket 316. The water flowing through the cooling jacket 316 in part diverges to the pilot or telltale pipe 318 and flows out of the outboard motor 30 through an outlet opening (not shown) to indicate that water is flowing through the cooling system 272. The conjunction passage 314, the intake and exhaust cooling jacket 316 and the pilot water discharge pipe 318 together define a second cooling water passage. The second cooling water passage, however, can comprise fewer or additional passages and conduits, but preferably flows in proximity to the inner section of the intake passages.

There is no thermostat in this second water passage. This means that the thermostat 302 is arranged to permit the cooling water flowing through both of the first and second water passages, and the thermostat 302 prevents only the water within the first water passage from flowing therethrough when temperature of the water is lower than a preset temperature.

In addition, as best seen in FIG. 9, one of the water delivery passages 282 is branched off to an exhaust pipe cooling passage 320 through an opening 322. The cooling passage 320 is then connected to an exhaust pipe cooling conduit 324. The cooling conduit 324 is formed uniformly with the exhaust pipe assembly 146 in this embodiment. However, it is of course can be separately formed. The cooling conduit 324 has a discharge opening 326 at the lowermost portion thereof and it is located lower than an opening 328 of the exhaust pathway 147 (see FIG. 10). The exhaust pipe cooling passage 320, the opening 322 and the exhaust pipe cooling conduit 324 together define a third cooling water passage. The third cooling water passage, however, can comprise fewer or additional passages and conduits.

As best seen in FIG. 3, the cooling system 272 additionally includes a cooling sink comprising water reservoir sections 330, 332. These reservoir sections 330, 332 are defined in a fore part of the driveshaft housing 40 and parted from the exhaust sections 158, 190 and the lubricant reservoir 160 by a partition wall 334. That is, the water reservoir sections 330, 332 are adjacent to and separated from the exhaust sections 158, 190 and the lubricant reservoir 160 by a partition wall 334. This structure is advantageous because the water in the reservoir sections 330, 332 can cool the exhaust sections 158, 190 and the lubricant reservoir 160. A partition wall 338 extends generally horizontally to divide the reservoir sections 330, 332 but still they are connected with each other by openings through which the water supply pipe 288 and the driveshaft 128 extend. The water in the reservoir sections 330, 332 is supplied from the water pump 276. The water reservoir section 332 has a dam 342 and the water in the reservoir sections 332, 330 can overflows into a space defined between a forward portion of the driveshaft housing 40 and the swivel bracket 196.

Cooling water is, therefore, pumped by the water pump 276 into the water inlet passage 278 through the water inlet 274 and then goes up to the water delivery passages 282 through the water supply pipe 288. The water exudes in part from the water pump 276 and goes to the water reservoir sections 330, 332. Then, it overflows into the space defined between the driveshaft housing 40 and the swivel bracket 196.

The majority of the water is supplied to the water delivery passages 282. Some of the water is then delivered to the first cooling water passage including the combustion chamber cooling jacket 292 and the cylinder body cooling jacket 296 to cool down the cylinder head member 59 around the combustion chambers 60 and the cylinder body 50 around the cylinder bores 52. In this first water passage, as described above, the thermostat 302 is provided in the thermostat chamber 300 and controls the water flow therein based upon a temperature of the water. When the water temperature is lower than a predetermined temperature, the thermostat 302 prevents the water from flowing therethrough. Thus, the cylinder head member 59 and the cylinder body 50 are not excessively cooled. When the water temperature is higher than the predetermined temperature, the thermostat 302 permits the water flow therethrough. The water then flows to the first discharge conduit 304 and flows through the discharge passage 306. The water then passes through the second discharge conduit 308 and it is discharged to the space between the driveshaft housing 40 and the apron 179. The water finally returns to the body of water surrounding the outboard motor 30. That is, the discharge water bypasses the exhaust guide member 132 and no particular water discharge portion for the first cooling water passage is necessary in the exhaust guide member 174. The exhaust guide member 132, therefore, may have a more simple structure and manufacturing costs thereof can be reduced. In addition, the water discharge portion from the second discharge conduit 308 is covered by the apron 178, so even if it becomes dirty the outboard motor maintains a good appearance. The appearance of the water discharge portion on the driveshaft housing 40 does never affect the whole appearance of the outboard motor 30 anyway.

Some portion of water, in turn, is delivered to the second cooling water passage that includes the intake and exhaust cooling jacket 316 and cools both the exhaust ports 92 and the lower inner portion 86*b* lying between the exhaust ports 92. Then, the water is discharged outside of the motor 30 through certain passages which are not shown. As described above, because the lower inner portion 86*b* is heated by the exhaust ports 92, it requires more cooling than the upper inner portion 86*a*.

The second cooling water passage in this embodiment has the cooling jacket 316 in proximity to the lower inner portion 86*b* and fresh water is supplied to this jacket 316 directly from the delivery passages 282. Thus, the lower inner portion 86*b* is well cooled and the temperature of this portion 86*b* can be almost the same as the temperature of the upper inner portion 86*a* that is not cooled by the cooling jacket 316. Additionally, because there is no thermostat provided in this second cooling water passage, water can always flow through this second cooling passage. The cooling system 272 in this embodiment thus does not need a pressure relief valve for protecting the water pump 276 from possible excessive pressure.

Another portion of the water in the delivery passages 282 goes to the third cooling water passage that includes the exhaust pipe cooling conduit 324 to cool the exhaust pipe assembly 146. The water then goes to the exhaust section 144 from the discharge opening 326 of the cooling conduit 324 and further to the other exhaust sections 158, 190. It is finally discharged outside through the propeller hub 192. In this process, the respective exhaust sections 144, 158, 190 are well cooled by the water flowing therethrough. Since the cooling conduit 324 has the discharge opening 326 at the lowermost portion thereof and it is located lower than the opening 328 of the exhaust pipe assembly 146, the water discharged from the opening 326 cannot enter the opening 328. This is advantageous because no cooling water may enter to the combustion chambers 60 through the exhaust system 78. Further, since fresh water is supplied to this third water passage directly from the delivery passages 282, the exhaust pipe 146 can be cooled significantly by the water that has a relatively low temperature.

As described above, the engine 32 has the counter-flow type arrangement. The air intake system 76 and the exhaust system 78 are disposed on the starboard side. Since the other side, i.e., portside, has a relatively large space, other engine components, particularly, electrical devices can be easily placed on this side. Furthermore, as mentioned above, when storing the outboard motor, the steering handle 230 (see FIG. 3) is placed on the portside. When the operator lays the outboard motor 30 on the ground, he or she necessarily puts the steering handle 230 down. This means that the air intake system 76 and the exhaust system 78 turned upward. Thus, fuel and lubricant are prevented from accumulating therein when the motor 30 lies in this position. The handle 230 also protects the cowling 46, 48 of the outboard motor 30 when the outboard motor 30 is laid on the ground.

In addition, usually the shift cable for operating the transmission switchover mechanism 186 is positioned on the portside, while a remote control cable for controlling the throttle valves is positioned on the starboard side. The location of the carburetors 88 on the starboard side in this arrangement is convenient for disposing the remote control cable.

Of course, the foregoing description is that of a preferred embodiment of the invention, and various changes and modifications may be made without departing from the spirit and scope of the invention, as defined by the appended claims.

What is claimed is:

1. An outboard motor including an internal combustion engine, an exhaust guide, and a lubrication system including a lubricant reservoir that is located below the exhaust guide, the engine comprising a cylinder body defining a plurality of cylinder bores in which pistons reciprocate, said pistons being coupled to a crankshaft that is covered by a crank case forming a crank chamber, a cylinder head affixed to an end of said cylinder body and defining combustion chambers with said pistons and said cylinder bores, a plurality of air intake passages supplying air charges to said combustion chambers, a plurality of exhaust passages for discharging burnt charges from said combustion chambers, the intake and exhaust passages being located on the same side of the cylinder body, at least one crank chamber lubricant return passage communicating with said crank chamber and said lubricant reservoir, said return passage being located on the same side of the cylinder body as said intake and exhaust passages, an opening of said crank case return passage being located at least in part on a substantially vertical side wall of said crank case.

2. An outboard motor as in claim 1, wherein said reservoir includes an insertion port located on an upper side of the reservoir and a drain located under the insertion port, the insertion port being pointed towards said drain.

3. An outboard motor as in claim 2 wherein said reservoir further includes a lower surface that is inclined towards said drain.

4. An outboard motor as in claim 2, further including an induction system for supplying an air charge to said engine, said induction system including a throttling device, the insertion port of said reservoir being located under said throttling device.

5. An outboard motor as in claim 2, wherein said return passage is located on a side of the reservoir where the insertion port is also located.

6. An outboard motor as in claim 2, said insertion port is formed at least in part in said crank chamber return passage.

7. An outboard motor including an internal combustion engine, an exhaust guide, and a lubrication system including a lubricant reservoir that is located below the exhaust guide, the engine comprising a cylinder body defining a plurality of cylinder bores in which pistons reciprocate, said pistons being coupled to a crankshaft that is covered by a crank case forming a crank chamber, a cylinder head affixed to an end of said cylinder body and defining combustion chambers with said pistons and said cylinder bores, a plurality of air intake passages supplying air charges to said combustion chambers, a plurality of exhaust passages for discharging burnt charges from said combustion chambers, the intake and exhaust passages being located on the same side of the cylinder body, at least one crank chamber lubricant return passage communicating with said crank chamber and said lubricant reservoir, said return passage being located on the same side of the cylinder body as said intake and exhaust passages.

8. An outboard motor as in claim 7, wherein the engine further includes intake and exhaust valves for opening and closing the intake and exhaust passages, a cam shaft for actuating said intake and exhaust valves, a cam shaft chamber in which the cam shaft is contained, a breather passage connecting said cam chamber to said oil reservoir, said passage being located on a side of said engine opposite said intake and exhaust passages.

9. An outboard motor as in claim 7, wherein said exhaust passages communicate with a second exhaust passage that is formed in said exhaust guide.

10. An outboard motor as in claim 7, wherein said engine additionally comprises a cooling system that is configured to supply coolant to at least said cylinder body and to said cylinder head, said cooling system including a coolant channel formed in said exhaust guide, said coolant channel formed along the periphery of said second exhaust passage.

11. An outboard motor as in claim 10, wherein said lubrication system includes a plurality of lubrication passages that extend through said exhaust guide, and said coolant channel lies between said second exhaust passage and said lubrication passages, an escape passage is located between said second exhaust passage and said lubrication passages.

12. An outboard motor as in claim 7, wherein said outboard motor is pivotally supported by an upper mount for rotation about a pivot axis, the upper mount being located within the exhaust guide, the center of gravity of the outboard motor lying at substantially the same level as the upper mount.

13. An outboard motor as in claim 12, wherein at least one of said coolant passages extends through a channel formed on a top side of said upper mount.

14. An outboard motor as in claim 7, further including a handle for operating the outboard motor, the handle being located on a side of the outboard motor opposite the induction and exhaust passages.

15. An outboard motor including an internal combustion engine and a lubrication system for lubricating said engine and including a lubricant reservoir that is located below the engine, the engine comprising a cylinder body defining a plurality of cylinder bores in which pistons reciprocate, said pistons being coupled to a crank shaft, a crank case for covering the crank shaft, the reservoir including an insertion port located on an upper side of the reservoir and a drain located under the insertion port, the insertion port being pointed towards said drain.

16. An outboard motor as in claim 15, wherein said reservoir further includes a lower surface that is inclined towards said drain.

17. An outboard motor as in claim 15, further including an induction system for supplying an air charge to said engine, said induction system including a throttling device, the insertion port of said reservoir being located under said throttling device.

18. An outboard motor as in claim 15, further including a crank chamber lubricant return passage that communicates with said crank case and said lubricant reservoir, said return passage being located on a side of the reservoir where the insertion port is also located.

19. An outboard motor as in claim 15, further including a crank chamber lubricant return passage that communicates with said crank case and said lubricant reservoir, said insertion port is formed at least in part in said crank chamber return passage.

20. An outboard motor including an internal combustion engine and a lubrication system for lubricating said engine and including a lubricant reservoir that is located below the engine, the engine comprising a cylinder body defining a plurality of cylinder bores in which pistons reciprocate, said pistons being coupled to a crank shaft, a crank case for covering the crank shaft, the reservoir including an insertion port located on an upper side of the reservoir and a drain located under the insertion port, said insertion port and said drain being located in a same vertical plane.

21. An outboard motor as in claim 20, wherein said reservoir further includes a lower surface that is inclined towards said drain.

22. An outboard motor as in claim 21, further including an induction system for supplying an air charge to said engine, said induction system including a throttling device, the insertion port of said reservoir being located under said throttling device.

23. An outboard motor as in claim 21, further including a crank chamber lubricant return passage that communicates with said crank case and said lubricant reservoir, said return passage being located on a side of the reservoir where the insertion port is also located.

24. An outboard motor as in claim 21, further including a crank chamber lubricant return passage that communicates with said crank case and said lubricant reservoir, said insertion port is formed at least in part in said crank chamber return passage.

25. An outboard motor including an internal combustion engine and a lubrication system for lubricating said engine and including a lubricant reservoir that is located below the engine, the engine comprising a cylinder body defining a plurality of cylinder bores in which pistons reciprocate, said pistons being coupled to a vertically extending crankshaft, a crank case for covering the crank shaft, the lubrication system including a crank case return passage that communicates with said reservoir and said crank case, an opening of said crank case return passage being located at least in part on a substantially vertical side wall of said crank case.

26. An outboard motor as in claim 25 wherein said opening of said crank case return passages is also located on a substantially horizontal bottom surface of said crank case.

27. An outboard motor as in claim 25, wherein said motor includes at least a first and second crank case return passage, said first return passage passages having an opening into said crank case, said second return passage having an opening into said crank case, the opening of said second return passage being at least in part higher in a vertical direction than the opening of first return passage.

28. An outboard motor as in claim 25, wherein said motor includes at least a first and second crank case return passage, said first return passage passages having an opening into said crank case, said second return passage having an opening into said crank case, the opening of said second return passage is higher in a vertical direction than the opening of first return passage.

* * * * *